US012680450B2

(12) United States Patent
Zillante et al.

(10) Patent No.: US 12,680,450 B2
(45) Date of Patent: Jul. 14, 2026

(54) HYBRID TUNNEL BORING USING COMBINATION OF THERMAL AND MECHANICAL PROCESSES

(71) Applicant: Phoenix Boring Inc., San Francisco, CA (US)

(72) Inventors: Roberto Zillante, San Francisco, CA (US); Thorin Tobiassen, San Francisco, CA (US); Thomas Egan, San Francisco, CA (US)

(73) Assignee: Phoenix Boring, Inc., San Francisco, CA (US)

( * ) Notice: Subject to any disclaimer, the term of this patent is extended or adjusted under 35 U.S.C. 154(b) by 0 days.

(21) Appl. No.: 19/230,966

(22) Filed: Jun. 6, 2025

(65) Prior Publication Data

US 2025/0376926 A1 Dec. 11, 2025

Related U.S. Application Data

(60) Provisional application No. 63/656,938, filed on Jun. 6, 2024.

(51) Int. Cl.
*E21D 9/10* (2006.01)

(52) U.S. Cl.
CPC ..... *E21D 9/1073* (2013.01); *E21D 9/104* (2013.01)

(58) Field of Classification Search
CPC ..... E21D 9/104; E21D 9/1073; E21B 7/14; E21B 7/146; E21C 37/16
See application file for complete search history.

(56) References Cited

U.S. PATENT DOCUMENTS 642,605 A * 2/1900 Hahn ..... F23D 11/10 239/427.3
1,284,398 A * 11/1918 McKinlay ..... E21D 9/1093 175/11

(Continued)

FOREIGN PATENT DOCUMENTS

CA 3222036 A1 12/2022
CN 104499943 A 4/2015

(Continued)

OTHER PUBLICATIONS

Rossi et al "The influence of thermal treatment on rock-bit interaction: a study of a combined thermo-mechanical drilling (CTMD) concept" Geotherm Energy 8, 16 (2020)—https://geothermal-energy-journal.springeropen.com/articles/10.1186/s40517-020-00171-y.

(Continued)

*Primary Examiner* — Janine M Kreck
(74) *Attorney, Agent, or Firm* — Polygon IP, LLP

(57) ABSTRACT

Novel hybrid tunnel boring methods, systems, and apparatuses are described. Example hybrid methods integrate (a) thermal processing, e.g., preconditioning and/or thermal spallation (which may be used as pre-treatment), and (b) mechanical processing while boring tunnels in rock and other formations. Thermal processing and mechanical processing may be used alternatively or simultaneously. For example, the preconditioning may use thermal energy to induce thermal shock and weaken the rock (e.g., cause expansion stress, micro-fractures, thermal spallation, etc.). This preconditioning changes the relevant properties of the rock relative to the additional (e.g., mechanical) excavation, including, among other things, effective compressive stress, abrasion properties, and hardness. This preconditioned rock can therefore be efficiently removed using mechanical drilling tools, resulting in, for example, faster boring speeds, reduced tool wear, enhanced precision, and longer deploy- (Continued)

ment lengths (e.g., in comparison to conventional TBM and especially MTBM approaches).

19 Claims, 13 Drawing Sheets

(56) References Cited

U.S. PATENT DOCUMENTS

| | | | | | |
|---|---|---|---|---|---|
| 3,205,953 | A | | 9/1965 | Ferrabee | |
| 3,475,055 | A | * | 10/1969 | Snedden | E21D 9/1073 239/536 |
| 4,234,235 | A | * | 11/1980 | Robbins | E21D 9/0879 299/56 |
| 4,260,194 | A | * | 4/1981 | Blindow | E21D 9/1073 299/60 |
| 4,630,869 | A | * | 12/1986 | Akesaka | E21D 9/0879 299/71 |
| 4,790,394 | A | | 12/1988 | Dickinson, III et al. | |
| 5,217,363 | A | * | 6/1993 | Brais | F23D 14/76 239/401 |
| 5,567,141 | A | * | 10/1996 | Joshi | F23L 7/007 239/419 |
| 5,863,101 | A | * | 1/1999 | Seear | E21C 25/58 299/1.1 |
| 7,337,859 | B2 | | 3/2008 | Volkel et al. | |
| 9,062,499 | B2 | | 6/2015 | Braga et al. | |
| 9,366,088 | B2 | * | 6/2016 | Cox | E21D 9/1006 |
| 10,480,249 | B2 | | 11/2019 | Samuel et al. | |
| 10,539,254 | B2 | | 1/2020 | Zillante et al. | |
| 10,584,585 | B2 | | 3/2020 | Helming | |
| 11,136,886 | B1 | * | 10/2021 | Helming | E21D 9/1066 |
| 11,492,904 | B2 | | 11/2022 | Wright et al. | |
| 11,608,687 | B2 | | 3/2023 | Torres et al. | |
| 11,959,338 | B2 | | 4/2024 | Zillante et al. | |
| 2005/0173153 | A1 | | 8/2005 | Alft et al. | |
| 2006/0060383 | A1 | | 3/2006 | Volkel et al. | |
| 2007/0125580 | A1 | | 6/2007 | Hall et al. | |
| 2010/0078414 | A1 | | 4/2010 | Perry et al. | |
| 2010/0089576 | A1 | | 4/2010 | Wideman et al. | |
| 2011/0278270 | A1 | | 11/2011 | Braga et al. | |
| 2014/0231398 | A1 | | 8/2014 | Land et al. | |
| 2015/0361750 | A1 | | 12/2015 | Zediker et al. | |
| 2016/0160618 | A1 | | 6/2016 | Batarseh et al. | |
| 2017/0159370 | A1 | | 6/2017 | Evans et al. | |
| 2017/0161885 | A1 | | 6/2017 | Parmeshwar et al. | |
| 2017/0306703 | A1 | | 10/2017 | Samuel et al. | |
| 2019/0085688 | A1 | | 3/2019 | Helming | |
| 2020/0126386 | A1 | | 4/2020 | Michalopulos et al. | |
| 2021/0262306 | A1 | | 8/2021 | Batarseh | |
| 2022/0056800 | A1 | | 2/2022 | Wright et al. | |
| 2022/0082017 | A1 | | 3/2022 | Abrams et al. | |
| 2022/0136333 | A1 | | 5/2022 | Araque et al. | |
| 2022/0220851 | A1 | | 7/2022 | Helming | |
| 2022/0235612 | A1 | | 7/2022 | Holtzman | |
| 2022/0389763 | A1 | | 12/2022 | Torres et al. | |
| 2023/0145203 | A1 | | 5/2023 | Feng et al. | |
| 2023/0228155 | A1 | | 7/2023 | Toews et al. | |
| 2023/0304401 | A1 | | 9/2023 | Wright et al. | |
| 2023/0407707 | A1 | | 12/2023 | Batarseh | |
| 2024/0093590 | A1 | | 3/2024 | Torres et al. | |
| 2024/0253145 | A1 | | 8/2024 | Helming et al. | |

FOREIGN PATENT DOCUMENTS

| | | | | | |
|---|---|---|---|---|---|
| CN | 103527085 | B | * | 9/2015 | |
| CN | 108222958 | A | * | 6/2018 | E21D 9/11 |
| CN | 108612475 | A | | 10/2018 | |
| CN | 109958392 | A | | 7/2019 | |
| KR | 101282945 | B1 | | 7/2013 | |
| WO | WO-2006105013 | A2 | * | 10/2006 | E21B 7/18 |
| WO | 2019217813 | A1 | | 11/2019 | |
| WO | 2020005850 | A1 | | 1/2020 | |
| WO | 2022256795 | A1 | | 12/2022 | |
| WO | 2024145567 | A1 | | 7/2024 | |
| WO | 2024145582 | A1 | | 7/2024 | |
| WO | 2025014906 | A2 | | 1/2025 | |
| WO | 2025106548 | A1 | | 5/2025 | |

OTHER PUBLICATIONS

Rossi, et al "A combined thermo-mechanical drilling technology for deep geothermal and hard rock reservoirs" Geothermics, vol. 85, 2020, 101771—https://www.sciencedirect.com/science/article/abs/pii/S0375650519303293?via%3Dihub.

U.S. Appl. No. 18/524,287, Non Final Office Action mailed Oct. 6, 2025, 23 pgs.

International Application Serial No. PCT/US25/32698, Search Report and Written Opinion mailed Oct. 14, 2025, 10 pgs.

U.S. Appl. No. 17/804,805, Non Final Office Action mailed Aug. 8, 2022, 17 pgs.

U.S. Appl. No. 17/804,805, Notice of Allowance mailed Nov. 14, 2022, 8 pgs.

U.S. Appl. No. 18/524,287, Final Office Action mailed Jul. 3, 2025, 19 pgs.

U.S. Appl. No. 18/524,287, Non Final Office Action mailed Feb. 20, 2025, 20 pgs.

U.S. Appl. No. 18/524,287, Restriction Requirement mailed Nov. 18, 2024, 7 pgs.

International Application Serial No. PCT/US2022/072655, International Preliminary Report on Patentability, mailed Dec. 14, 2023, 7 pgs.

International Application Serial No. PCT/US2022/072655, Search Report and Written Opinion dated Sep. 19, 2022.

* cited by examiner

HYBRID TUNNEL BORING USING COMBINATION OF THERMAL AND MECHANICAL PROCESSES

CROSS-REFERENCE TO RELATED APPLICATIONS

This application claims the benefit under 35 U.S.C. § 119 (e) of U.S. Provisional Patent Application 63/656,938, filed on 2024 Jun. 6, which is incorporated herein by reference in its entirety for all purposes.

FIELD OF TECHNOLOGY

This disclosure pertains to the field of tunnel boring, specifically to systems, methods, and apparatuses for boring through grounds comprising rock and/or soils as well as other underground materials using various combinations of thermal and mechanical systems, such as thermal preconditioning and/or thermal spallation, mechanical drilling, and the like.

BACKGROUND

Conventional mechanical-boring methods, such as tunnel boring machines (TBMs), micro tunnel boring machines (MTBMs), horizontal directional drilling (HDD) heads, and the like, face significant challenges when working in solid rock layers, or even worse, when encountering unexpected hard rock formations (while boring through soft soils). The wear and tear on cutting tools, coupled with reduced boring speeds, lead to inefficiencies and increased operational costs, not to mention the incompatibility of regular ground cutting tools when finding unexpected rock formations or even boulders. Furthermore, there are particular challenges and costs associated with smaller-diameter bore applications, e.g., less than about 2 meters in diameter. Such tunnels are too small to permit personnel access, e.g., for changing the worn-out mechanical teeth on the boring heads.

For example, when an MTBM deployment is expecting hard rock formations, for example, it is common practice to artificially increase the target diameter of a tunnel operation to preserve personnel access to the cutting head for tool replacement due to wear on longer run lengths. Alternatively, boring distances between shafts may be decreased by adding more access shafts. Either option represents a large additional cost for MTBM applications.

In the case of HDD, a transition from soil condition to hard rock condition (and/or vice versa) may require pulling the entire drill string out of the bore, e.g., to replace/repair the drill head. This approach increases the downtime/cost and the risk of the tunnel collapse. Finally, thermal-spallation drilling is effective at the volumetric removal of hard rock in certain applications but can lack precision and energy efficiency when used by itself.

What is needed are novel systems and methods capable of boring through different types of materials (e.g., hard rocks and soft soils) without a need for the removal of boring heads from the boring tunnels, with the potential to increase productivity via both reduced downtime via not having to switch heads and increased advance rate by being able to use the fastest method for the geology at hand.

SUMMARY

Novel hybrid tunnel boring methods, systems, and apparatuses are described. Such hybrid methods integrate (a) thermal processing, e.g., preconditioning and/or thermal spallation, and (b) mechanical processing while boring tunnels in grounds comprising rocks, soils, and other formations. On-demand thermal processing and mechanical processing may be used alternatively or simultaneously. For example, the preconditioning may use thermal energy to induce thermal shock and weaken the rock (e.g., cause expansion stress, micro-fractures, thermal spallation, etc.). If not removed from the rock face by spallation, the remaining rock will experience preconditioning changes to the relevant properties of the rock (e.g., effective compressive stress, abrasion properties, and hardness) thereby enabling additional (e.g., mechanical) boring/excavation. This preconditioned rock can therefore be efficiently removed using a set of mechanical boring implements resulting in, for example, faster boring speeds, reduced tool wear, enhanced precision, and longer deployment lengths (e.g., in comparison to conventional TBM and MTBM approaches). Furthermore, the provided methods and systems allow to switch back and forth between different operating modes in a single deployment (e.g., without removing a hybrid boring head from the underground tunnel). The thermal torch device can be turned off at any time (when not needed), e.g., regular ground or softer geological conditions are encountered, recurring to a purely mechanical approach. Similarly, the thermal torch device can be turned back on at any time, e.g., when a rock formation is encountered.

Clause 1. A hybrid boring head defined by a primary axis and configured for boring an underground tunnel through ground comprising both soil and rock using different ones of multiple operating modes of the hybrid boring head, the hybrid boring head comprising: a frame comprising one or more spoil drain openings and configured to be attached to a head actuating unit for rotating the hybrid boring head about the primary axis and advancing the hybrid boring head along the primary axis while boring the underground tunnel; a thermal torch device attached to the frame and configured to generate a thermal stream at least along a thermal stream axis directed to a bore face formed by the hybrid boring head in the underground tunnel while boring the underground tunnel, wherein the thermal torch device are selected from the group consisting of a burner, a turbine, and a plasma torch; and a set of mechanical boring implements attached to the frame and configured to contact and remove the ground from the bore face while boring the underground tunnel, wherein the set of mechanical boring implements is selected from the group consisting of mechanical rollers, mechanical teeth, and hard-faced structural elements.

Clause 2. The hybrid boring head of clause 1, wherein: the thermal stream axis is not colinear or parallel to the primary axis thereby enabling location control of an interface between the thermal stream and the bore face, and the location control is provided by a rotational angle of the hybrid boring head about the primary axis.

Clause 3. The hybrid boring head of clause 1, wherein: the frame comprises a thermal unit opening extending through the frame and housing the thermal torch device, and the thermal unit opening comprises a front orifice and a back orifice, the front orifice is configured to direct the thermal stream to the bore face, and the back orifice is configured to house one or more lines for operating the thermal torch device positioned in the thermal unit opening.

Clause 4. The hybrid boring head of clause 3, wherein the thermal torch device is recessed into the thermal unit opening away from the front orifice.

Clause 5. The hybrid boring head of clause 3, wherein an offset of the thermal torch device relative to the front orifice determines a spread angle of the thermal stream as the thermal stream exits the thermal unit opening and is directed to the bore face.

Clause 6. The hybrid boring head of clause 5, wherein the hybrid boring head is steerable when forming a portion of the underground tunnel through the rock by controlling a dwell time of the thermal stream on portions of the bore face during rotation.

Clause 7. The hybrid boring head of clause 3, wherein the hybrid boring head is configured to prevent the ground from entering the thermal unit opening through the front orifice.

Clause 8. The hybrid boring head of clause 3, wherein the position of the thermal torch device relative to the frame is adjustable.

Clause 9. The hybrid boring head of clause 3, wherein the thermal torch device is pivotable relative to the frame thereby changing an angle between the primary axis and the thermal stream axis.

Clause 10. The hybrid boring head of clause 3, wherein the thermal torch device is axially movable within the thermal unit opening thereby changing the spread angle of the thermal stream as the thermal stream exits the thermal unit opening and is directed to the bore face.

Clause 11. The hybrid boring head of clause 3, wherein the power output of the thermal torch device is adjustable and is different for the different ones of multiple operating modes of the hybrid boring head.

Clause 12. The hybrid boring head of clause 1, further comprising one or more additional thermal torch devices attached to the frame and configured to generate an additional thermal stream directed to the bore face, wherein a path of the thermal stream axis on the bore face is offset relative to paths of the additional thermal stream axis.

Clause 13. The hybrid boring head of clause 1, wherein the frame comprises a steering surface that is not colinear or parallel to the primary axis thereby enabling steering of the hybrid boring head while forming the underground tunnel through the soil using a combination a rotational angle of the hybrid boring head about the primary axis and an axial movement of the hybrid boring head along the primary axis.

Clause 14. The hybrid boring head of clause 1, wherein the frame further comprises a spoil intake defined by an intake angle and extending between an outer perimeter of the frame and at least one of the one or more spoil drain openings.

Clause 15. The hybrid boring head of clause 1, wherein: the set of mechanical boring implements are mechanical teeth comprising a front set, a reaming set, and a crushing set, the front set is configured to form the bore face, the reaming set is configured to form a tunnel wall, and the crushing set is configured to assist the ground to pass through the drain openings.

Clause 16. The hybrid boring head of clause 1, wherein the set of mechanical boring implements comprises abrasion-resistant coatings or inserts comprising one or more materials selected from the group consisting of tungsten carbide, boron carbide, and polycrystalline diamond.

Clause 17. The hybrid boring head of clause 1, wherein the set of mechanical boring implements is offset relative to the thermal stream axis such that the thermal stream does not contact the set of mechanical boring implements.

Clause 18. The hybrid boring head of clause 1, wherein the frame further comprises a set of cooling channels for circulating a cooling fluid through the frame.

Clause 19. The hybrid boring head of clause 1, further comprising one or more sensors configured to measure one or more of (a) torque between the hybrid boring head and the head actuating unit, (b) thrust between the hybrid boring head and the head actuating unit, (c) pressure inside the underground tunnel, and (d) temperature of one or more components of the hybrid boring head.

Clause 20. The hybrid boring head of clause 1, wherein the frame further comprises one or more fluid channels for delivering and removing a drilling fluid while forming the underground tunnel through at least the soil.

Clause 21. A hybrid boring system for boring an underground tunnel through ground comprising both soil and rock using different ones of multiple operating modes, the hybrid boring system comprising: a hybrid boring head comprising a frame, a thermal torch device attached to the frame, and a set of mechanical boring implements attached to the frame; a head actuating unit mechanically coupled to the frame of the hybrid boring head by a shaft for rotating the hybrid boring head about a primary axis and advancing the hybrid boring head along the primary axis while boring the underground tunnel; and an external unit positioned outside of the underground tunnel and at least fluidically connected with the hybrid boring head.

Clause 22. The hybrid boring system of clause 21, further comprising a system controller configured to select one of the multiple operating modes and to steer the hybrid boring head through the ground, both the soil and the rock, while boring the underground tunnel.

Clause 23. The hybrid boring system of clause 22, wherein: the hybrid boring head comprises one or more sensors configured to measure one or more of (a) torque between the hybrid boring head and the shaft, (b) thrust between the hybrid boring head and the shaft, (c) pressure inside the underground tunnel, and (d) temperature of one or more components of the hybrid boring head, and the system controller is configured to receive input from the one or more sensors and select one of the multiple operating modes based on the input.

Clause 24. The hybrid boring system of clause 23, wherein: the head actuating unit is configured to measure (a) torque between the head actuating unit and the shaft and (b) thrust between the head actuating unit and the shaft, the system controller is configured to receive additional input from the head actuating unit and select one of the multiple operating modes based on the input.

Clause 25. The hybrid boring system of clause 22, wherein the system controller is configured to vary the rotational speed and translation speed of the hybrid boring head based on a current one of the multiple operating modes.

Clause 26. The hybrid boring system of clause 22, wherein the system controller is configured to activate or deactivate the thermal torch device based on the angular position of the hybrid boring head.

Clause 27. The hybrid boring system of clause 21, wherein: the hybrid boring head is configured to remove the ground from a bore face thereby generating spoils sent to the external unit, and the external unit is configured to receive the spoils from the hybrid boring head and analyze the spoils for at least one of composition, size, color, and temperature.

Clause 28. The hybrid boring system of clause 27, wherein the external unit comprises one or more inspection units configured to analyze the spoils and selected from the group consisting of a vision unit, an artificial intelligence (AI) unit trained on spoil analysis, and selection of the operating modes.

Clause 29. The hybrid boring system of clause 28, wherein the head actuating unit is configured to steer the hybrid boring head by varying rotational speed and translation speed of the hybrid boring head based on inputs from one or more inspection units.

Clause 30. The hybrid boring system of clause 29, wherein the external unit is further configured to steer the hybrid boring head by controlling power to the thermal torch device based on inputs from one or more inspection units.

Clause 31. The hybrid boring system of clause 21, wherein the external unit is configured to supply (a) power to the thermal torch device when forming a portion of the underground tunnel through the rock using a power supply line and (b) a drilling fluid to the hybrid boring head when forming a portion of the underground tunnel through the soil using a drilling-fluid supply line.

Clause 32. The hybrid boring system of clause 31, wherein: the thermal torch device is a burner comprising a fuel inlet, an oxidant inlet, and a 3-way valve connected to the oxidant inlet, the external unit is configured to supply oxidant to the thermal torch device using an oxidant supply line, and the 3-way valve is fluidically coupled to both the drilling-fluid supply line and the oxidant supply line thereby allowing the drilling fluid to flow through the thermal torch device when forming a portion of the underground tunnel through the soil using a drilling-fluid supply line.

Clause 33. The hybrid boring system of clause 31, wherein the power supply line is configured to supply one or more of electricity, propane, and diesel.

Clause 34. The hybrid boring system of clause 21, wherein the external unit comprises a gas detection module configured to detect natural gas within the underground tunnel and enter a burnoff mode.

Clause 35. The hybrid boring system of clause 34, wherein the thermal torch device is configured to perform the burnoff mode by supplying oxidant to the thermal torch device.

Clause 36. The hybrid boring system of clause 21, wherein the head actuating unit is a part of the external unit.

Clause 37. The hybrid boring system of clause 21, wherein the head actuating unit is positioned inside the underground tunnel during the operation of the hybrid boring system.

Clause 38. The hybrid boring system of clause 21, wherein the external unit comprises a cooling subunit fluidically coupled with the hybrid boring head and configured to circulate cooling liquid between the cooling subunit and the hybrid boring head.

Clause 39. The hybrid boring system of clause 21, wherein the hybrid boring system is a micro tunnel boring machine (MTBM).

Clause 40. The hybrid boring system of clause 21, wherein the hybrid boring system is a horizontal directional drilling (HDD).

Clause 41. A hybrid tunnel boring method for boring an underground tunnel through ground comprising both soil and rock, the hybrid tunnel boring method is performed using a hybrid boring head comprising a frame, a thermal torch device attached to the frame, and a set of mechanical boring implements attached to the frame, the hybrid tunnel boring method comprising: (block) operating the hybrid boring head in a thermal-only mode to precondition or spall the rock using the thermal torch device while positioning at least some of the set of mechanical boring implements away from the rock; (block) operating the hybrid boring head in a mechanical-only mode by not supplying power to the thermal torch device and engaging the soil with the set of mechanical boring implements; and (block) operating the hybrid boring head in a hybrid mode in which both the set of mechanical boring implements and the thermal torch device are active simultaneously.

Clause 42. The hybrid tunnel boring method of clause 41, wherein the hybrid boring head transitions among the thermal-only mode, the mechanical-only mode, and the hybrid mode without removing the hybrid boring head from the underground tunnel.

Clause 43. The hybrid tunnel boring method of clause 41, wherein the hybrid boring head transitions among the thermal-only mode, the mechanical-only mode, and the hybrid mode based on detected changes in the composition of the ground.

Clause 44. The hybrid tunnel boring method of clause 41, wherein the hybrid boring head transitions to the mechanical-only mode based on detecting the soil.

Clause 45. The hybrid tunnel boring method of clause 41, wherein the hybrid boring head switches or transitions to the thermal-only mode or the hybrid mode based on detecting the rock.

Clause 46. The hybrid tunnel boring method of clause 41, wherein the hybrid boring head is advanced along a primary axis while rotating about the primary axis in each of the mechanical-only mode, the thermal-only mode, and the hybrid mode.

Clause 47. The hybrid tunnel boring method of clause 41, wherein: operating the hybrid boring head in one of the thermal-only mode, the mechanical-only mode, and the hybrid mode generates spoils, and the hybrid tunnel boring method further comprises (block) removing the spoils from the underground tunnel.

Clause 48. The hybrid tunnel boring method of clause 47, further comprising: (block) analyzing the spoils removed from the underground tunnel for at least one of composition, size, color, and temperature; and (block) selecting among the mechanical-only mode, the thermal-only mode, and the hybrid mode based on at least one of the composition, the size, the color, and the temperature of the spoils removed from the underground tunnel.

Clause 49. The hybrid tunnel boring method of clause 41, further comprising: (block) monitoring one or more operating parameters of the hybrid boring head, wherein the one or more operating parameters (a) torque applied to the hybrid boring head, (b) thrust applied to the hybrid boring head, (c) pressure inside the underground tunnel, and (d) temperature of one or more components of the hybrid boring head; and (block) selecting among the mechanical-only mode, the thermal-only mode, and the hybrid mode based on the one or more operating parameters.

Clause 50. The hybrid tunnel boring method of clause 41, further comprising (block) steering the hybrid boring head within the ground by controlling the rotational orientation of the hybrid boring head.

Clause 51. The hybrid tunnel boring method of clause 50, wherein (block) steering is performed in the mechanical-only mode by fixing the rotational orientation and axially advancing the hybrid boring head.

Clause 52. The hybrid tunnel boring method of clause 50, wherein (block) steering is performed in the thermal-only mode or the hybrid mode by modulating the dwell time of the thermal stream produced by the thermal torch device at the rotational orientation of the hybrid boring head.

Clause 53. The hybrid tunnel boring method of clause 41, further comprising retracting the hybrid boring head away from a bore face when transitioning into the thermal-only mode.

Clause 54. The hybrid tunnel boring method of clause 41, further comprising blocking the thermal torch device from spoil intrusion.

Clause 55. The hybrid tunnel boring method of clause 41, wherein, in the hybrid mode, removing a portion of the ground using the thermal torch device forms a tunnel wall having a first diameter (D1); and contacting the tunnel wall with the set of mechanical boring implements enlarges the diameter of the tunnel wall to a second diameter (D2), larger than the first diameter (D1).

Clause 56. The hybrid tunnel boring method of clause 41, wherein the thermal torch device is selected from the group consisting of a burner, a turbine, and a plasma torch.

Clause 57. The hybrid tunnel boring method of clause 41, wherein the set of mechanical boring implements is selected from the group consisting of mechanical rollers, mechanical teeth, and hard-faced structural elements.

Clause 58. The hybrid tunnel boring method of clause 41, wherein: the thermal torch device is attached to the frame and generates a thermal stream at least along a thermal stream axis not colinear or parallel to a primary axis of the hybrid boring head thereby enabling location control of an interface between the thermal stream and the underground tunnel, and the location control is provided by a rotational angle of the hybrid boring head about the primary axis.

Clause 59. The hybrid tunnel boring method of clause 41, wherein: the frame comprises a thermal unit opening extending through the frame and housing the thermal torch device, and the thermal unit opening comprises a front orifice and a back orifice, the front orifice is configured to direct a thermal stream from the thermal torch device, and the back orifice is configured to house one or more lines for operating the at least one of the thermal torch device positioned in the thermal unit opening.

Clause 60. The hybrid tunnel boring method of clause 59, wherein the thermal torch device is recessed into the thermal unit opening away from the front orifice.

These and other embodiments are described further below with reference to the figures.

BRIEF DESCRIPTION OF THE DRAWINGS

The included drawings are for illustrative purposes and serve only to provide examples of possible structures and operations for the disclosed inventive systems, apparatus, and methods. These drawings in no way limit any changes in form and detail that may be made by one skilled in the art without departing from the spirit and scope of the disclosed implementations.

DETAILED DESCRIPTION

Introduction

Figure 1A:
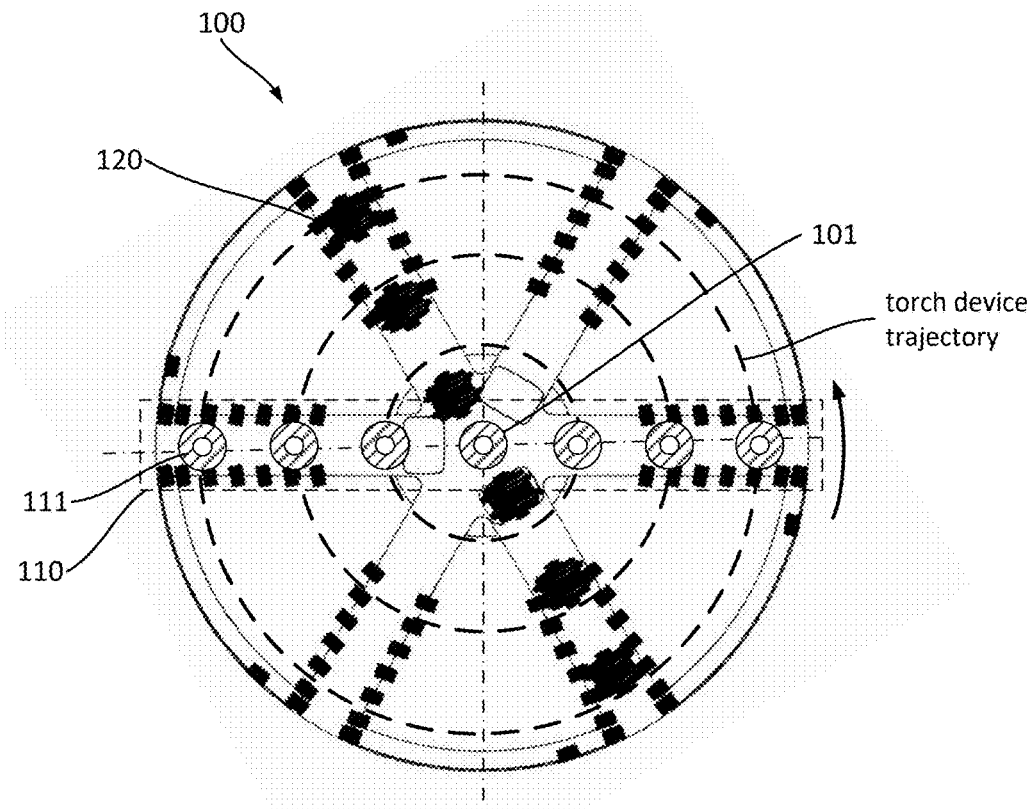
FIGS. 1A and 1B are front views of two examples of a hybrid boring head comprising both thermal torch devices and a set of mechanical boring implements.
Figure 1B:
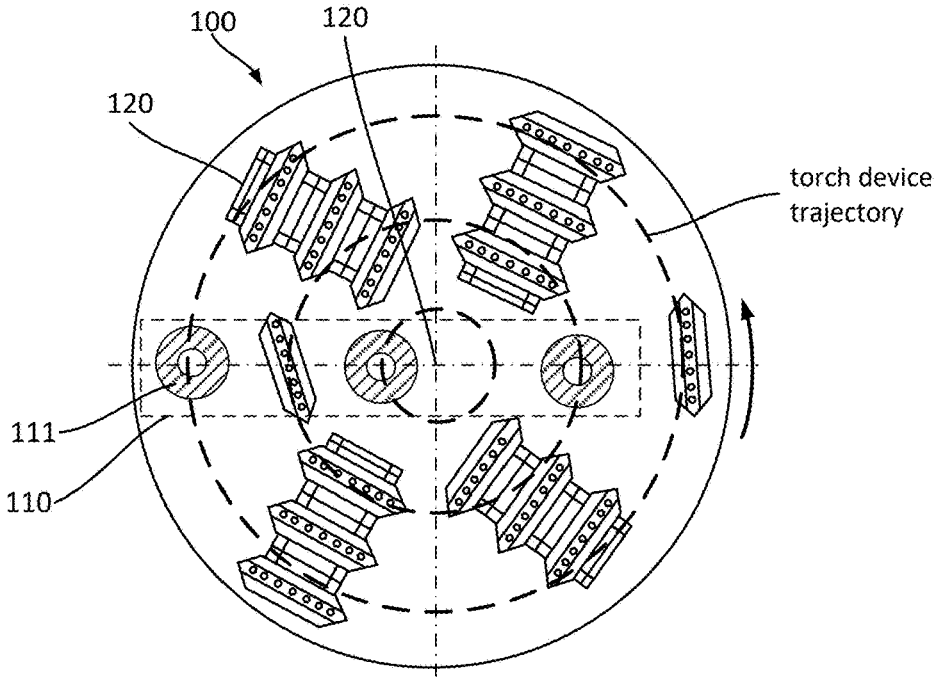

Referring to FIGS. 1A and 1B, hybrid tunnel boring methods and systems utilize hybrid boring heads, each comprising a thermal unit 110 (comprising one or more thermal torch devices 111) and a set of mechanical boring implements 120 (which may be collectively referred to as a mechanical unit). These methods and systems combine thermal processing (e.g., preconditioning and/or thermal-spallation) with mechanical processing (e.g., mechanical excavation) to enhance boring efficiency, reduce tool wear, and achieve precise bore sizes to a degree not possible with conventional approaches. Specifically, these methods and systems use thermal energy to weaken the rock (and in some examples to remove at least some of the rock) followed by mechanical excavation to remove the preconditioned material. The applied thermal energy induces thermal shocks and weakens the rock (e.g., causes expansion stress, microfractures, thermal spallation, etc.). This changes the relevant properties of the rock relative to the additional (e.g., mechanical) excavation, including, among other things, effective compressive stress, abrasion properties, and hardness. This preconditioned rock can therefore be efficiently removed using mechanical drilling tools, resulting in, for example, faster boring speeds, reduced tool wear, enhanced precision, and longer deployment lengths.

It should be noted that hybrid tunnel boring methods and systems can be dynamically configured based on the composition of the bored material. For example, the characteristics (e.g., head rotating speed, linear advancement speed, power output, temperature, flow rate) of thermal processing can be changed and, in some specific examples, thermal processing can be completely or selectively turned off, especially when transitioning from rock to regular ground or softer geological conditions, recurring to a purely mechanical approach. Similarly, the transition from the regular ground or softer geological conditions to rock may correspond to switching from purely mechanical to hybrid thermal-assisted boring mode might be needed. Similarly, the characteristics (e.g., head rotating speed, linear advancement speed) of mechanical processing can be changed and, in some specific examples, mechanical processing can be completely turned off (e.g., retracted away from the bored face).

Figure 1C:
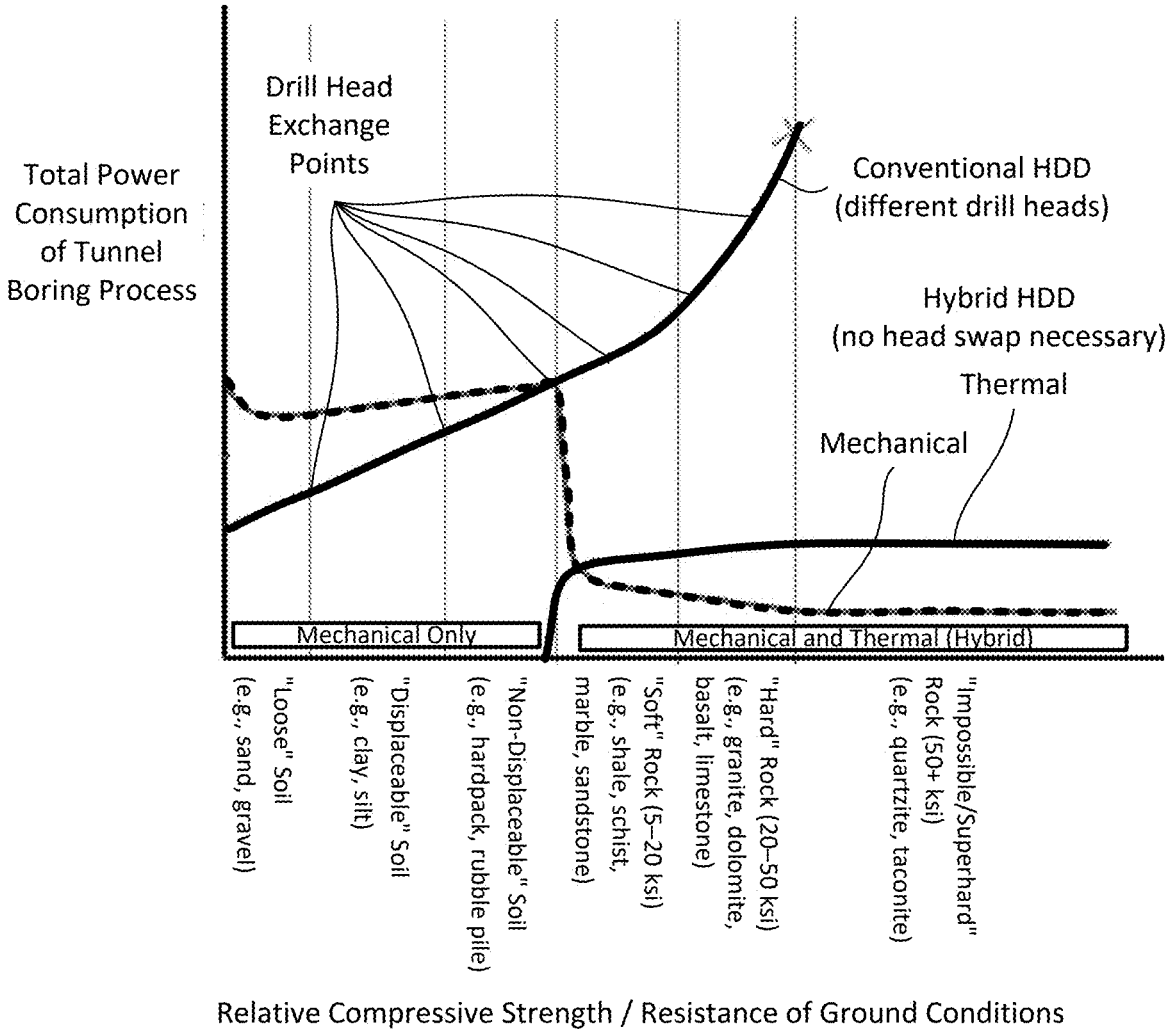
FIG. 1C is a plot of the total power consumption of the drilling process while boring an underground tunnel through different types of ground using either a conventional mechanical system or a hybrid boring system described herein.

Referring to FIG. 1C, various examples of underground materials can be processed using these hybrid tunnel boring methods and systems, e.g., quartzite, basalt, granite, limestone, gabbro, diabase, and gneiss. However, other materials are within the scope. It should be noted that some of these materials are difficult and may not be possible to process using conventional TBM approaches due to various difficulties and/or costs. Many of these materials are hard, often homogenous geologies with high abrasivity and compressive strength that are commonly encountered at depth. In general, these geologies share (1) high compressive strength, (2) high abrasivity, and (3) are commonly encountered at depth. For purposes of this disclosure, typical ground materials are referred to as "soil" and "rock". Specifically, the "soil" is generally defined as any material having an unconfined compressive strength (UCS) of less than 5 ksi (kilopounds per square inch) with some examples including "loose" soil (e.g., sand, gravel), "displaceable" soil (e.g., clay, silt), and "non-displaceable" soil (e.g., hardpack, rubble pile). The "soil" is generally defined as any material having an unconfined compressive strength (UCS) of greater than 5 ksi with some examples including "soft" rock (5-20 ksi, e.g., shale, schist, marble, sandstone), "hard" rock (20-50 ksi, e.g., granite, dolomite, basalt, limestone), and "impossible/superhard" rock (50+ ksi, e.g., quartzite, taconite).

Specifically, FIG. 1C illustrates a comparative power profile of a hybrid horizontal directional drilling (HDD) system incorporating both mechanical and thermal boring components, as compared to a conventional HDD system requiring multiple drill head exchanges across varying ground conditions. The x-axis represents the relative compressive strength or resistance of ground conditions, which can be grouped into "soil" and "rock" categories as noted above. The y-axis reflects the total power consumption of the drilling process.

The conventional HDD curve (black solid line with inflection points) depicts an increasing power trend with the drill head exchange points identified. These drill head exchanges are needed to accommodate changes in ground conditions. Often, each head is optimized for a narrow range of compressive strengths, resulting in operational inefficiencies and downtime (e.g., a drill head has to be extracted from the underground tunnel for the replacement). Some head designs may be usable in adjacent zones (in reference to the graph), with worse efficiency and compromises across that range of ground conditions as a result, but no existing conventional head covers all ground conditions. Furthermore, multiple drill heads are often required to drill the same tunnel in the ground in which different types of rocks and soils are intermixed.

In contrast, the hybrid HDD profile (represented by a dashed line and a bottom solid line) demonstrates a continuous boring capability without requiring drill head exchange. The hybrid system operates in a mechanical-only mode through lower-compressive-strength materials and transitions to a mechanical+thermal hybrid mode for higher-compressive-strength rock. Within this hybrid mode, mechanical power consumption remains flat, while thermal power increases modestly to accommodate more resistant materials. This figure demonstrates that the hybrid boring head is capable of spanning a broader range of geological conditions with lower total energy consumption in the "hard" and "superhard" rock regimes while eliminating the need for head swaps and enabling continuous boring operations.

The hybrid tunnel boring systems and methods described herein are configured to operate in multiple modes depending on ground conditions, including a mechanical-only mode, a thermal-only mode, and a hybrid mode. In the mechanical-only mode, the boring head advances through the ground using a set of mechanical boring implements, such as rollers or teeth, without activating the thermal torch device. This mode is particularly suitable for soft or displaceable soils where thermal processing is unnecessary or inefficient. Mechanical-only operation reduces energy consumption and eliminates thermal system wear. Sensor feedback—including torque, thrust, and spoil flow rate—may be used to monitor tool performance and detect transitions in-ground type.

In contrast, the thermal-only mode utilizes the thermal torch device to deliver focused energy to the bore face, inducing thermal spallation or microfracturing of high-compressive-strength materials without active mechanical contact. This mode is advantageous when boring through super hard or abrasive rock formations that would otherwise cause excessive wear on mechanical implements. During thermal-only operation, the head may rotate slowly or remain stationary, and spoil may be removed via entrainment in the thermal jet stream. This mode can also be used to precondition the rock ahead of hybrid or mechanical operation, improving overall boring efficiency.

Overall, the performance characteristics of hybrid boring systems provide significant benefits over other conventional systems used in the TBM and MTBM industry and allow for faster and more efficient tunnel boring/drilling. One advantage is an increased production rate due to a complementary mechanism of action, i.e., reducing loads on mechanical excavation elements means the advance rate can be increased. Another advantage is reduced operating costs from improved tool wear, e.g., tools last longer with thermally preconditioned rock than in baseline geology. Furthermore, if a hybrid tunnel boring method is applied to typical MTBM industry contracts, decreased tool wear rate means greatly reduced overall project cost because using this hybrid approach can avoid upsizing the target diameter to much larger than the specific application requires in order to ensure access (e.g., personnel access) to the head for tool replacement, as is common in MTBM jobs Additional advantages include improved precision by providing a controlled and precise bore size compared to thermal methods alone (e.g., the mechanical portion of the hybrid solution provides precision) and improved energy efficiency. Specifically, reduced overall thermal energy is required compared to the process using thermal spallation alone because the thermal method doesn't have to achieve total volumetric removal. Furthermore, lower torque and thrust demand compared to conventional mechanical tunneling means less energy use during the mechanical processing portion of the hybrid tunnel boring methods.

Examples of Hybrid Boring Heads

Referring to FIGS. 1A and 1B, a hybrid tunnel boring system utilizes a hybrid boring head 100 comprising a thermal unit 110 (comprising one or more thermal torch devices 111) and a set of mechanical boring implements 120 to execute the hybrid tunnel boring methods described in this disclosure. Various examples of thermal torch devices (TTDs) are within the scope, e.g., convection-based thermal shock (such as plasma, combustion gases, pre-heated or pre-cooled thermofluids), electromagnetic heating methods (such as laser, microwave, etc.), as well as other heat/mass transfer means. For example, the combustion-based thermal units (e.g., turbine/afterburner, burner/torch/nozzle, etc.) can be made fuel agnostic allowing the use of diesel, liquefied natural gas (LNG), propane, biodiesel, synthetic fuels, carbon-sequestered or carbon-negative fuels, or hydrogen. This allows for high-energy tunnel boring but potentially carbon-neutral boring even in remote areas where electrical energy needed for plasma would not be available. For example, hydrogen can be used in urban areas where city water and city power are available with hydrogen being potentially generated on-site. Also, sub-ambient convective methods (e.g. liquid nitrogen) can also be field deployable without access to high-power electrical (generators or grid). Even where sufficiently desirable packaging of non-thermofluid delivery methods is possible, the ability to operate in the field without access to an electrical grid favors thermofluid methods in many cases.

The thermal unit 110 may operate on the rock via multiple non-exclusionary modes, such as (a) thermal preconditioning and (b) thermal spallation. Specifically, thermal preconditioning generates micro-fractures in the rock due to rapid thermal expansion stress. In other words, a portion of the rock is converted into preconditioned rock. Thermal spallation produces spallation on the bore face, which may be referred to as thermally-removed spoil to differentiate from mechanically-removed spoil. During the thermal spallation, there is no direct contact between the thermal unit 110 and the removed material (e.g., rock) on the bore face. On the contrary, mechanical spallation involves direct contact between the set of mechanical boring implements 120 and the removed material.

One having ordinary skills in art would understand that incidental contact between the thermal unit 110 and the removed material may occur (e.g., during the alignment of the hybrid boring head 100 in the bore, after the removed material is separated from the bore face, and other like situations). However, this direct contact is not a requirement for the material removal with the thermal spallation.

In some examples, thermal preconditioning is the only mode of operation for thermal unit 110. In other words, thermal processing does not involve any significant thermal spallation (e.g., the volume of the thermally removed spoil relative to the mechanically removed spoil is less than 10%, less than 5%, or even 0%). Monitoring of thrust and torque forces can be used to determine useful thresholds, potentially specific to the type of rock or soil being processed, that allow for either changing power input parameters or switching modes entirely between thermal mode, thermal mechanical hybrid mode, and mechanical mode. Thermal preconditioning is used to assist with mechanical removal that is performed using the same hybrid boring head 100.

An example of the hybrid boring head 100 in FIG. 1A may be suitable for predominantly mechanical spoil removal when thermal processing does not involve any significant thermal spallation and provides almost entirely thermal preconditioning. Design and selection decisions between these various embodiments may be driven by optimizations for capital expenditure, running costs, geology targeted, or application diameter, as determined by one skilled in the art. FIG. 1A shows a mechanical head with primarily teeth and few rollers (which would usually handle lower compressive strength rock), and a lower density of torch emitters per unit surface area of bore. This therefore describes a system with a lower power density that may not effect any volumetric removal via the thermal method but is still sufficient for thermal preconditioning and removal via mechanical scraping and some fragmentation via hardened rollers.

In some examples, thermally removed spoil is removed from at least the center of the bore and expands outward towards the target diameter. An example of the hybrid boring head 100 in FIG. 2A may be suitable for combined spoil removal, by both thermal and mechanical means, especially where higher compressive strength or hardness rock (granite, basalt, dolomite) is encountered, since FIG. 2A features a higher relative power density of torch emitters and rolling element rock fragmentation wheels. The volumetric ratio of the thermally-removed spoil relative to the mechanically-removed spoil may depend on the type of rock as well as the levels of thermal and mechanical power/energy delivered to the rock face.

Referring to FIGS. 2A-2D, in the illustrated example, the set of thermal torch devices comprises a thermal torch device 111 and one or more additional thermal torch devices 112. In this specific example, the thermal torch device 111 is colinear with the primary axis 101. Furthermore, the thermal torch device 111 is positioned between the additional thermal torch devices 112 along a secondary axis. Finally, the thermal torch device 111 is equally spaced from each of the additional thermal torch devices. As further described below, the set of thermal torch devices in combination with the rotation of the hybrid boring head 100 provides a thermal zone that acts on the rock to at least weaken the rock face.

Furthermore, the thermal torch device 111 protrudes past the additional thermal torch devices 112 along the primary axis 101 (toward the bore face). This arrangement may be optimal in order to shape the bore into a concave surface or hemisphere, which will provide efficient flow patterns for exposing the thermal jets to as much surface area via jet impingement as possible before dissipation.

Figure 2A:
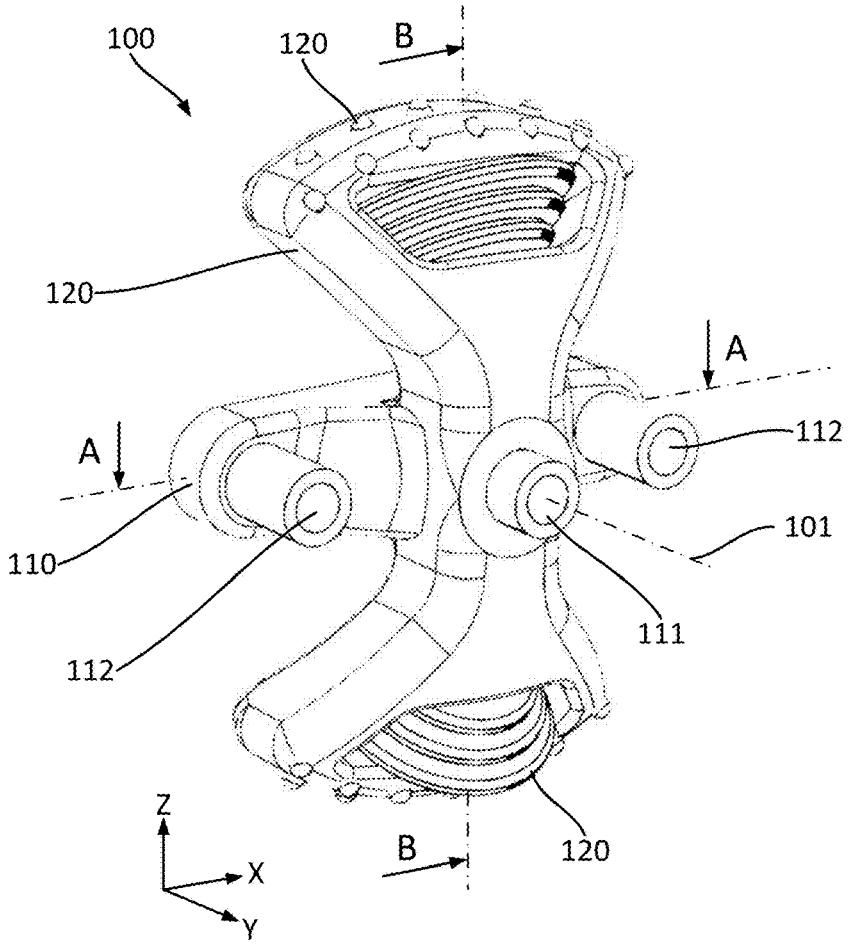
FIG. 2A is a perspective view of a hybrid boring head comprising three thermal torch devices and a set of mechanical boring implements, in accordance with some examples.

While three thermal torch devices are shown in FIG. 2A, any number of thermal torch devices are within the scope, e.g., one thermal torch device positioned at the center along the primary axis 101 or as many thermal torch devices as can fitted in the available space (e.g., surrounded by the set of mechanical boring implements 120) on the hybrid boring head 100. In some examples, one or more thermal torch devices may be pivoted to control the attack angle to cover different areas of the exposed boring face. More specifically, each pivotable/tiltable thermal torch device may be equipped with an actuator for changing the alignment from the primary axis 101, e.g., from 0 degrees (colinear) to almost 90 degrees or, more specifically, 0-60 degrees or even 0-45 degrees. This pivoting in combination with the rotation of the hybrid boring head 100 can reduce the need for additional thermal torch devices to cover the same front area. Alternatively, the attack angle (relative to the primary axis 101) may be fixed as further described below.

The set of mechanical boring implements 120 comprises a set of mechanical implements, such as, for example, mechanical rollers, mechanical teeth, and/or hard-faced structural elements. While rollers can be complicated, expensive, and hard to physically fit into a small packaging design (e.g., for MTBMs), rollers can provide high forces and longer wear lifetimes (since a roller has a more effective wear area than a single tooth of a compatible size). For example, MTBMs that are 450-750 mm (18-30") can use mechanical teeth (and not rollers) for sufficiently weakened materials (by previous thermal processing). Mechanical rollers, for example, may be used for bore removal via fragmentation. Mechanical teeth, for example, may be used for bore removal via either/both fragmentation or scraping/cutting. Hardfaced structural elements, for example, may be used in specific areas to both assist the above excavation elements and protect the machine. The set of mechanical boring implements 120 may include other mechanical devices now known or later developed that are capable of bore removal, assisting excavation elements, and/or protecting the machine.

In some examples, the set of mechanical boring implements 120 comprises multiple mechanical devices, e.g., equally spaced from the primary axis 101 and/or having different offsets from the primary axis 101. For example, a larger mechanical device may be positioned in the center (e.g., colinear with the primary axis 101) to cover the center portion of the bore, while one or more smaller mechanical devices are spaced at different radial distances.

Figure 2B:
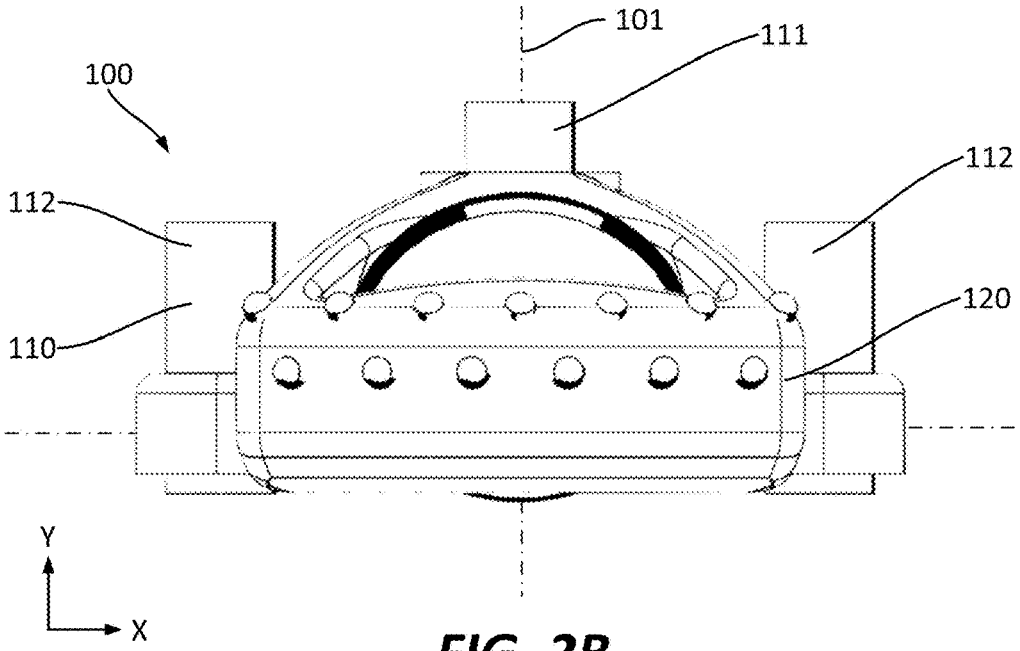
FIG. 2B is a top view of the hybrid boring head shown in FIG. 2A, in accordance with some examples.

Referring to FIGS. 2A and 2B, in some examples, the thermal unit 110 and the set of mechanical boring implements 120 are positioned on a mounting frame (e.g., comprising arms) capable of supporting these units relative to each other and relative to the rock. The mounting frame is configured to rotate (relative to the rock) enabling exposure of different parts of the rock to thermal processing (provided by the thermal unit 110) and mechanical processing (provided by the set of mechanical boring implements 120). Various options for integration of the thermal unit 110 and the set of mechanical boring implements 120 into the hybrid boring head 100 are within the scope.

Figure 2C:
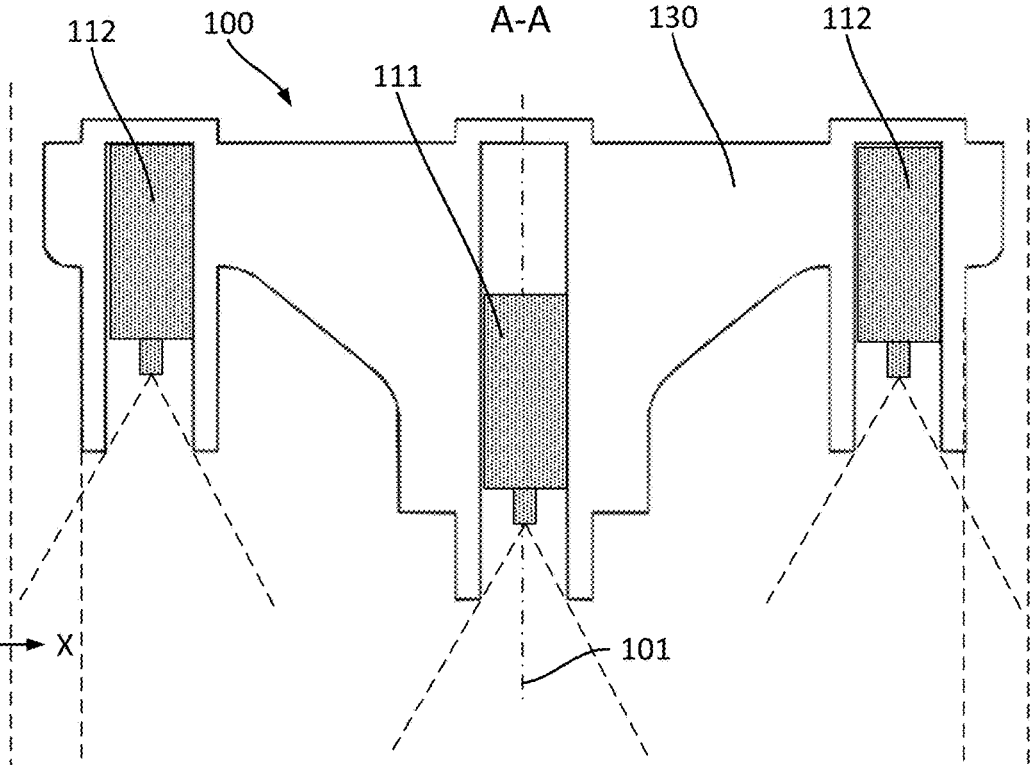
FIGS. 2C and 2D are two cross-sectional views of the hybrid boring head shown in FIG. 2A, in accordance with some examples.
Figure 2D:
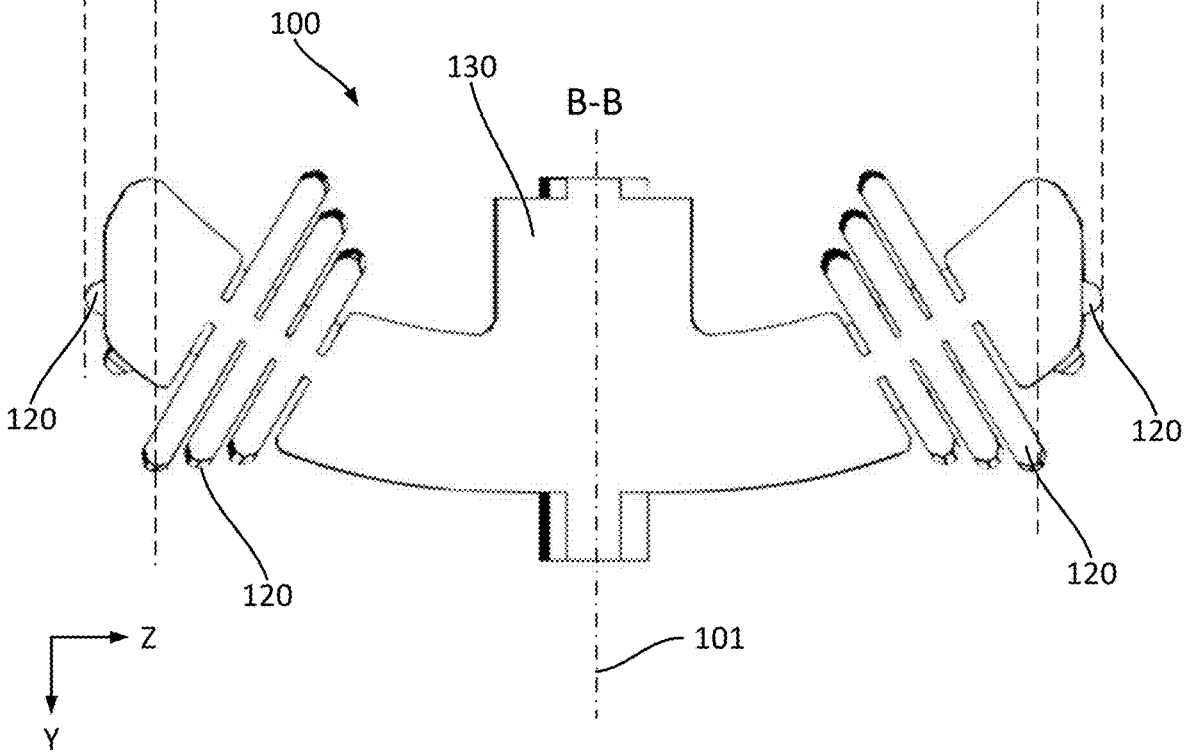

FIG. 2C is a cross-section detailing the placement of TTDs within one example of the hybrid boring head 100 in FIG. 2A. FIG. 2D is another cross-section showing an example placement of mechanical boring implements 120 (both rollers and teeth, in this depiction) within one example of the hybrid boring head 100 in FIG. 2A. The alternating pattern of TTD and mechanical elements (in this case, alternating at 90°) provides for exposure to high-temperature convective gases but as much delay between that exposure and contact with mechanical elements (teeth, rollers) to reduce undesired heating of those elements.

Figure 2E:
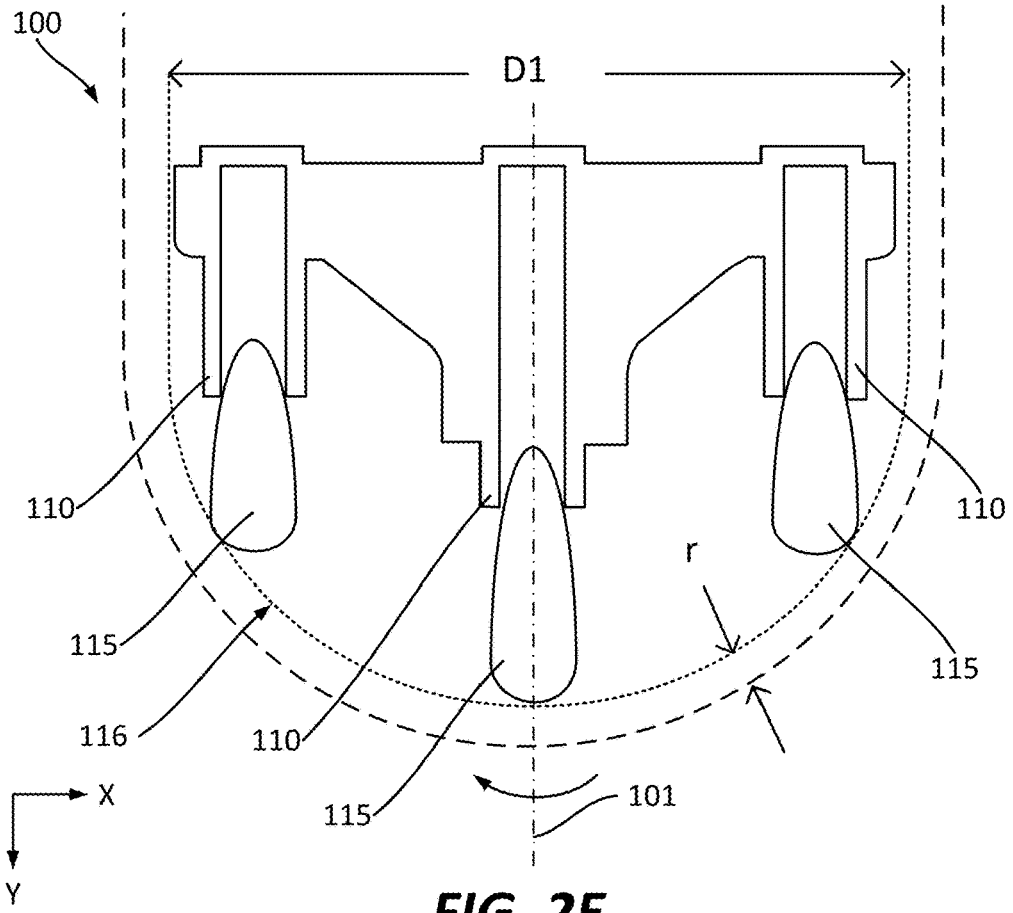
FIGS. 2E and 2F are two cross-sectional views of the hybrid boring head shown in FIG. 2A during operation of the hybrid boring head, in accordance with some examples.

FIG. 2E illustrates an example of the hybrid boring head 100 with three thermal units 110, each generating corresponding thermal zones (e.g., areas of maximum thermal effect, via direct heating or splash heating from impingement) 115. These thermal zones 115 collectively and in combination with the rotation of the thermal unit 110 define a rotary-swept thermal affected zone 116, matching with diameter "D1". Extending this thermal zone 116 into the rock face weakens the rock (to a depth identified by "r" in FIG. 2E) and, in some examples, generates thermally removed spoil. It should be noted that because of the nature of thermal processing, the thermal zone 116 extends beyond the boundaries of thermal unit 110. Therefore, direct contact between the thermal unit 110 and the removed material is not needed. In different embodiments, ground conditions, and operating parameters, thermally affected zone 116 could encompass a low percentage of the overall target diameter before mechanical removal (ie, 50% of target diameter) up to a high percentage of the overall target diameter before mechanical reaming (ie, 90-100% of target diameter). In some cases, the percentage of target diameter volumetrically removed via non-contact thermal can be determined intentionally via process parameters, whereas in other cases this would be economically driven via maintenance and refurbishment costs or power-limited by the TTDs relative to a particular geology being bored.

Figure 2F:
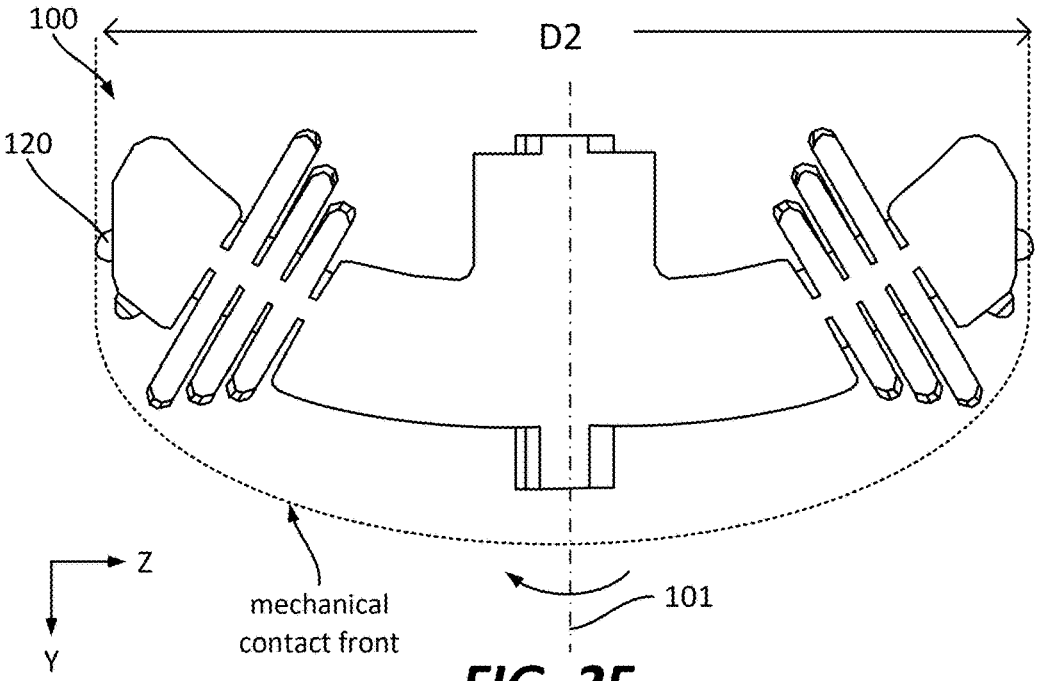

FIG. 2F is a cross-sectional view of an example method of operation of the set of mechanical boring implements 120 performing boring operations. If volumetric removal of the bore has occurred via thermal spallation to achieve an effective diameter "D1" (potentially 50-90% of a customer target diameter, 5-18" for HDD applications, 12-60" for MTBM applications, or 60"+ for TBM applications), then the mechanical excavation elements expand the bore from the effective diameter "D1" to a target diameter "D2" (associated with a mechanical contact front, where D2 necessarily matches the customer target diameter at 100%) by removing preconditioned rock/thermally weakened material. If significant volumetric removal did not occur, mechanical excavation elements are solely responsible for achieving bore diameter "D2". While FIG. 2F may not explicitly illustrate the removal of the front face via mechanical elements, this type of removal is within the scope where the rock face has been sufficiently thermally conditioned to be removed via mechanical scraping and/or rolling elements without undue wear or breakage.

FIGS. 3A-3E are different views of another example of a hybrid boring head 100. Specifically, the hybrid boring head 100 may be defined by a primary axis 101 and configured for boring an underground tunnel 590 through ground 580 comprising both soil 582 and rock 584 using different ones of multiple operating modes, such as a mechanical-only mode, a thermal-only mode, and a hybrid mode (described above). The hybrid boring head 100 comprises a frame 130, a set of mechanical boring implements 120, and a thermal unit 110 (comprising at least one thermal torch device 111).

Specifically, frame 130 comprises one or more spoil drain openings 134 and is configured to be attached to a head actuating unit 510 for rotating the hybrid boring head 100 about the primary axis 101 and advancing the hybrid boring head 100 along the primary axis 101 while boring the underground tunnel 590.

Figure 3A:
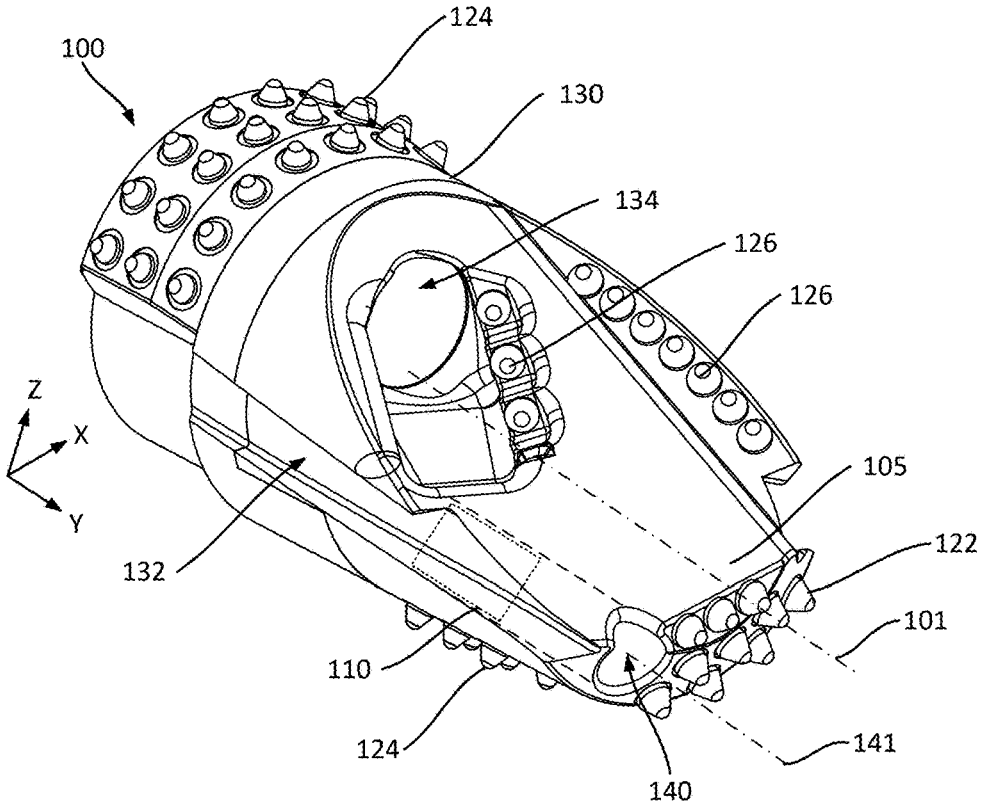
FIGS. 3A-3E are different views of another example of a hybrid boring head comprising a thermal torch device positioned in a thermal unit opening of the frame and a set of mechanical boring implements attached at different locations of the frame.
Figure 3B:
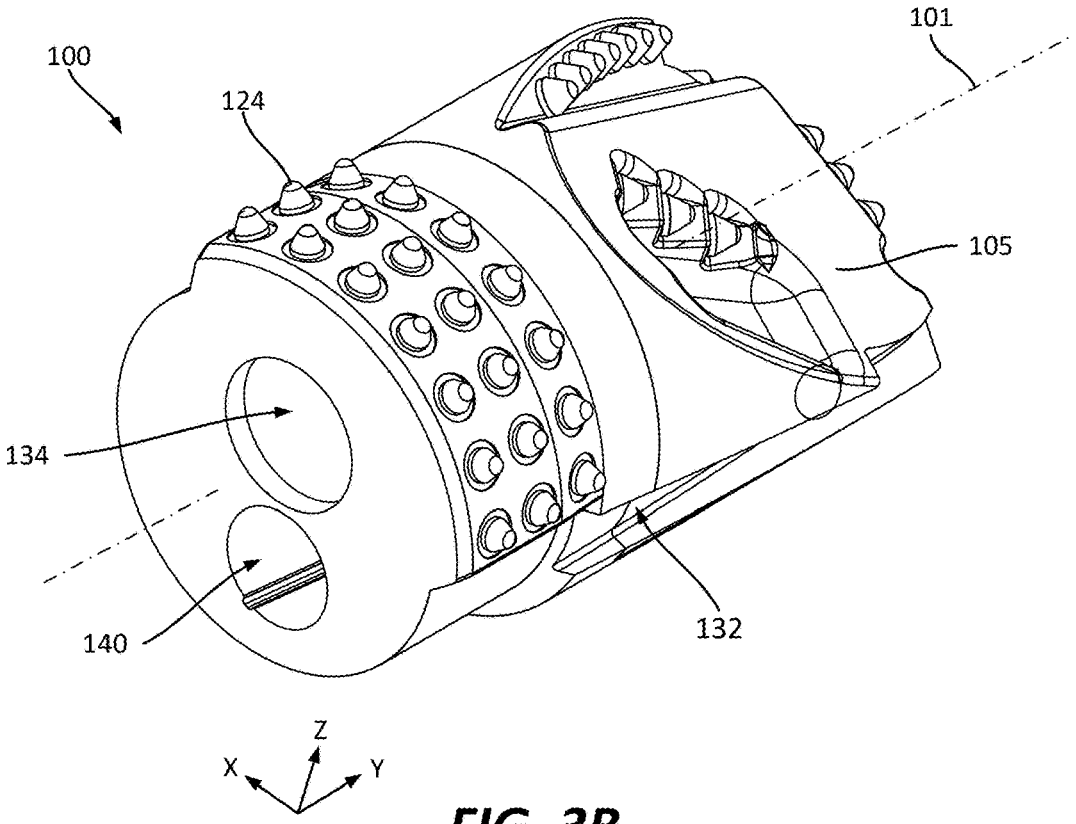
Figure 3C:
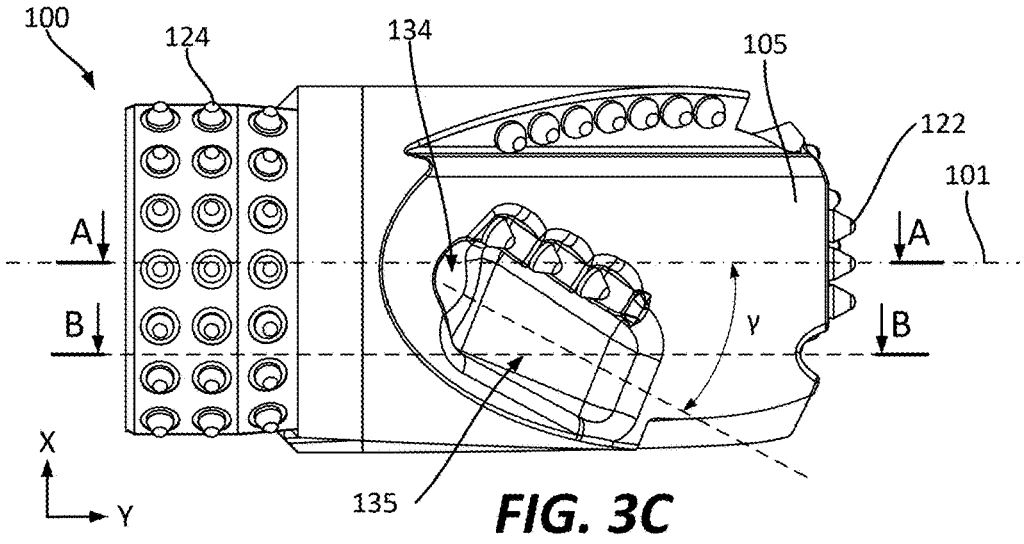

The frame 130 further comprises a thermal unit opening 140 extending through the frame 130 and housing the thermal torch device 111. The thermal unit opening 140 comprises a front orifice 148 and a back orifice 149. As shown in FIG. 3E, the front orifice 148 is configured to direct the thermal stream 599 to the bore face 592. The back orifice 149 is configured to house one or more lines for operating the thermal torch device 111 positioned in the thermal unit opening 140. The thermal torch device 111 is recessed into the thermal unit opening 140 away from the front orifice 148 thereby preventing direct contact between the thermal torch device 111 and ground (e.g., bore face 592 and/or spoils).

Figure 3D:
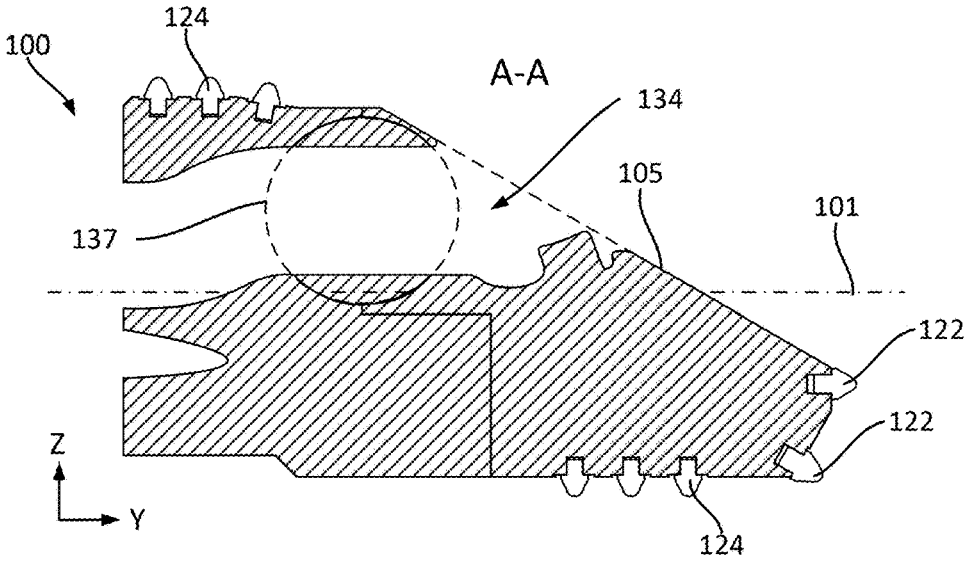
Figure 3E:
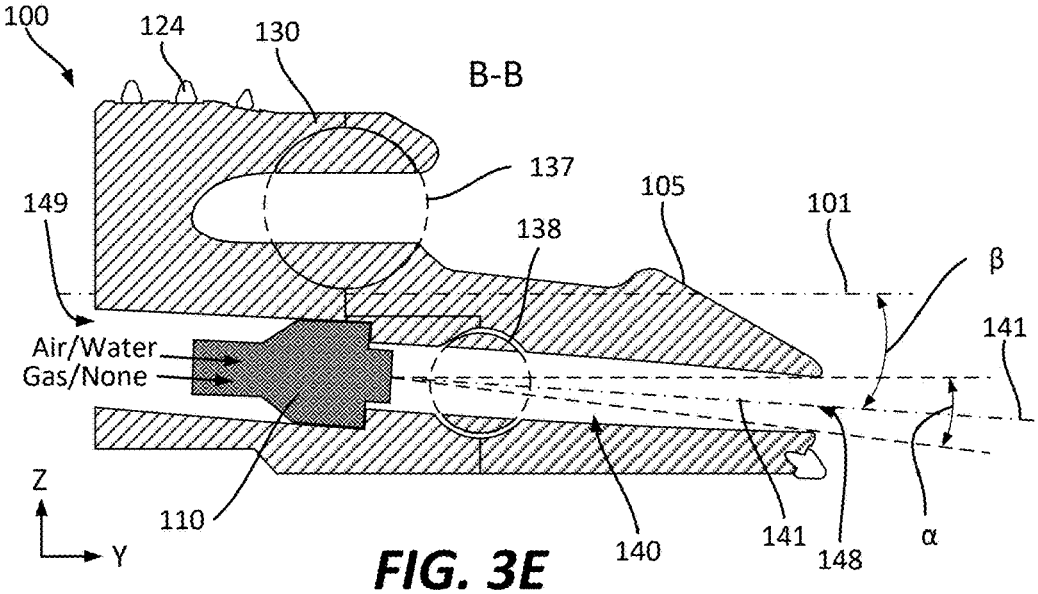

Referring to FIGS. 3D and 3E, the frame 130 may comprise a drain-opening valve 137 and/or a thermal-opening valve 138. The drain-opening valve 137 may be shut to prevent the flow through the spoil drain opening 134, e.g., in the mechanical-only mode. Specifically, a drilling fluid (e.g., bentonite) may be flown into the spoil drain opening 134 (from the back end) and evenly distributed out of the spoil drain opening 134 through seeping holes, e.g., positioned proximate to mechanical boring implements 120. The drain-opening valve 137 may be open during the hybrid and thermal-only modes to allow for the exhaust (if any) and spoils to pass through. Similarly, the thermal-opening valve 138 may be shut to prevent ingress of the ground into the thermal unit opening 140 and blocking/contacting the thermal torch device 111, e.g., in the mechanical-only mode. The thermal-opening valve 138 may be open during the hybrid and thermal-only modes to allow for the thermal stream 599 to exit the thermal unit opening 140.

In some examples, frame 130 comprises a steering surface 105 that is not colinear or parallel to the primary axis 101 thereby enabling steering of the hybrid boring head 100 while forming the underground tunnel 590 through the soil 582. Specifically, a combination of a rotational angle of the hybrid boring head 100 about the primary axis 101 and an axial movement of the hybrid boring head 100 along the primary axis 101 may be used.

Referring to FIG. 3C, in some examples, frame 130 further comprises a spoil intake 135 defined by an intake angle (v) and extending between an outer perimeter of the frame 130 and at least one of the one or more spoil drain openings 134. The intake angle (v) may be greater than 15°, greater than 30°, or even greater than 45°.

Referring to FIG. 3A, in some examples, frame 130 further comprises one or more fluid channels 132 for delivering and removing a drilling fluid while forming the underground tunnel 590 through at least the soil 582.

Figure 5A:
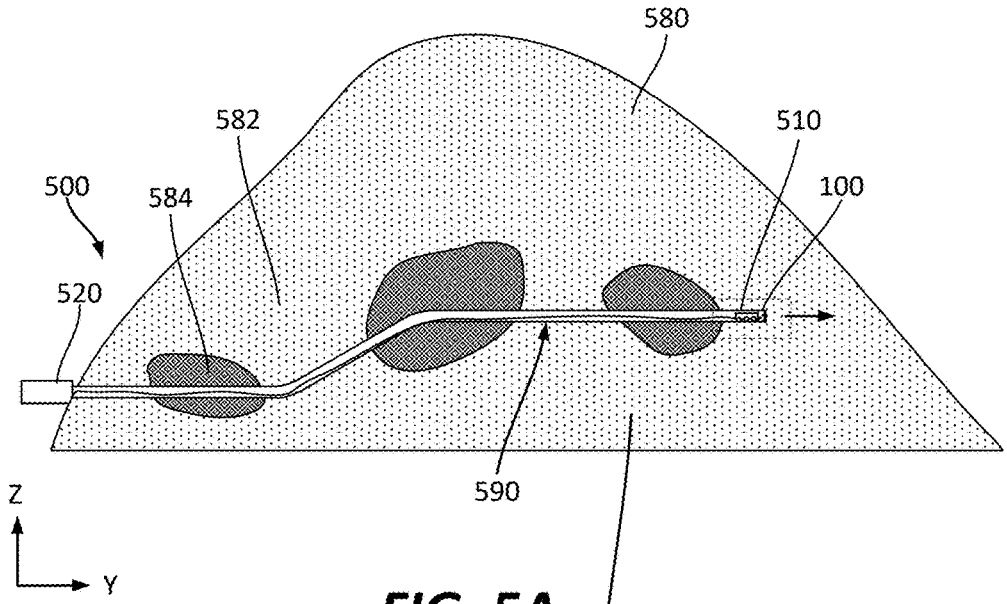
FIGS. 5A and 5B are schematic views of a hybrid boring system while forming an underground tunnel, in accordance with some examples.
Figure 5B:
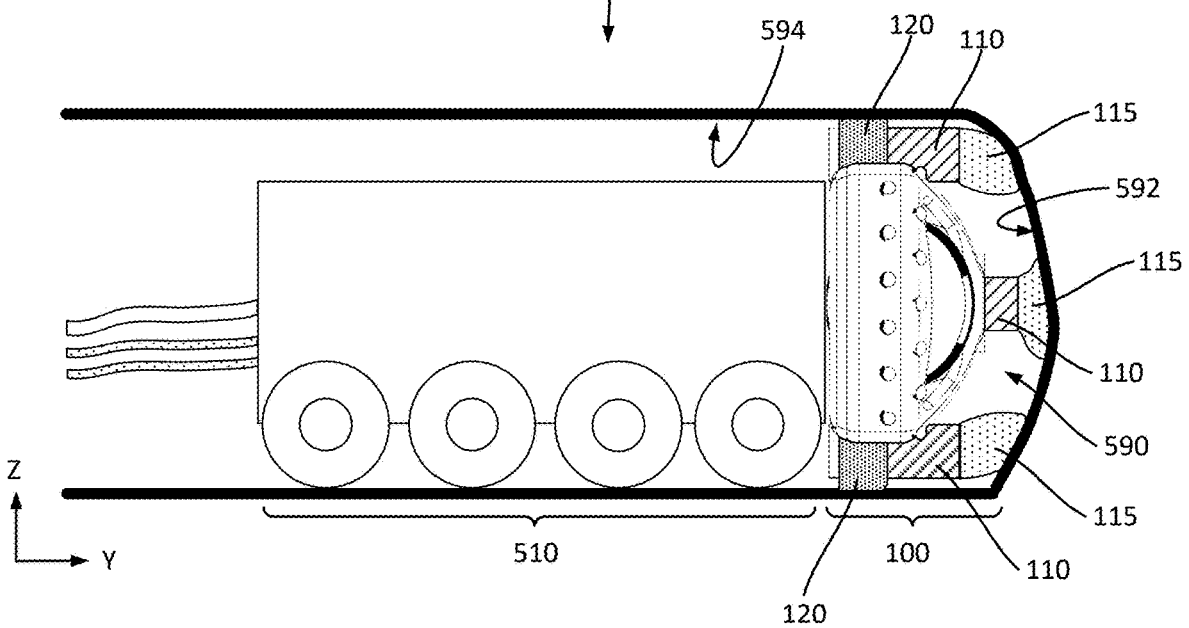
Figure 5C:
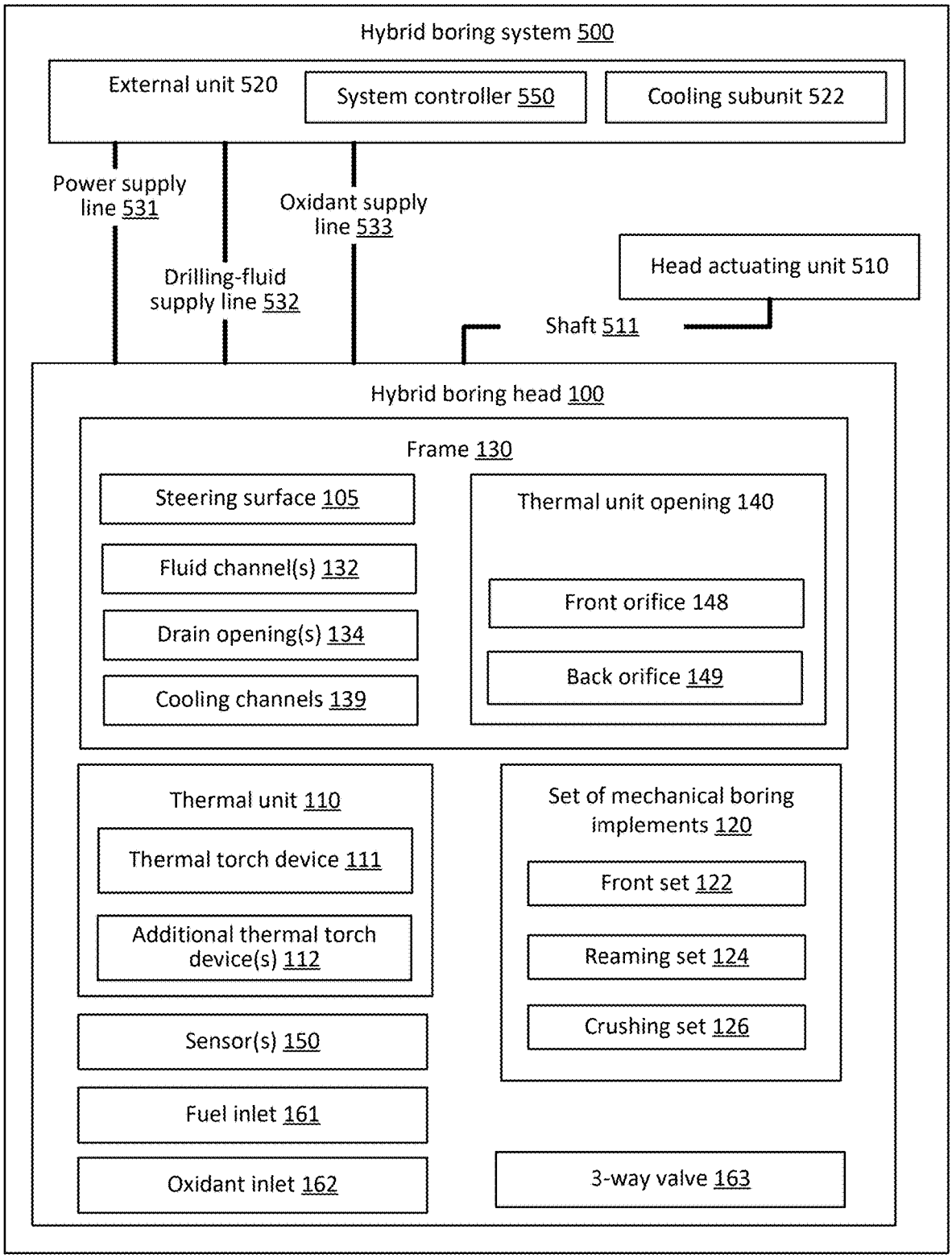
FIG. 5C is a schematic block diagram of the hybrid boring system, in accordance with some examples.

Referring to FIG. 5C, in some examples, a frame 130 further comprises a set of cooling channels 139 for circulating a cooling fluid through the frame 130.

Referring to FIGS. 3A-3E, the thermal torch device 111 is attached to the frame 130 and configured to generate a thermal stream 599 at least along a thermal stream axis 141 directed to a bore face 592 formed by the hybrid boring head 100 in the underground tunnel 590 while boring the underground tunnel 590, wherein the thermal torch device 111 are selected from the group consisting of a burner, a turbine, and a plasma torch.

Figure 3F:
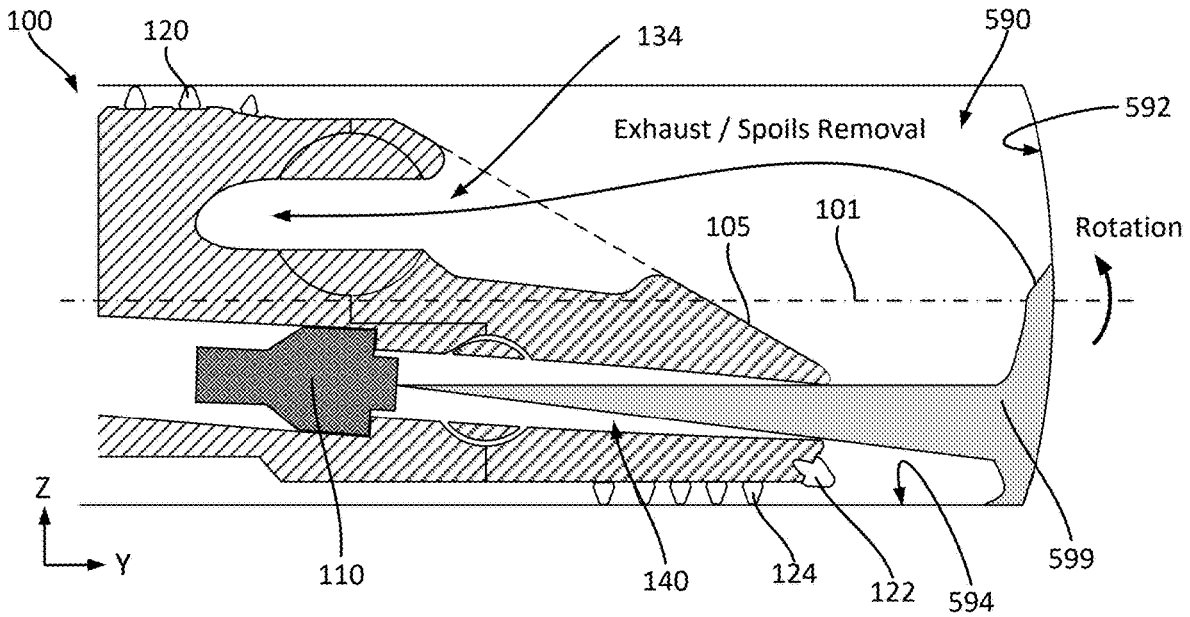
FIGS. 3F and 3G are two cross-sectional views of the hybrid boring head of FIGS. 3A-3E, illustrating two rotational positions of the hybrid boring head within an underground tunnel and the distribution of the thermal stream within the underground tunnel.
Figure 3G:
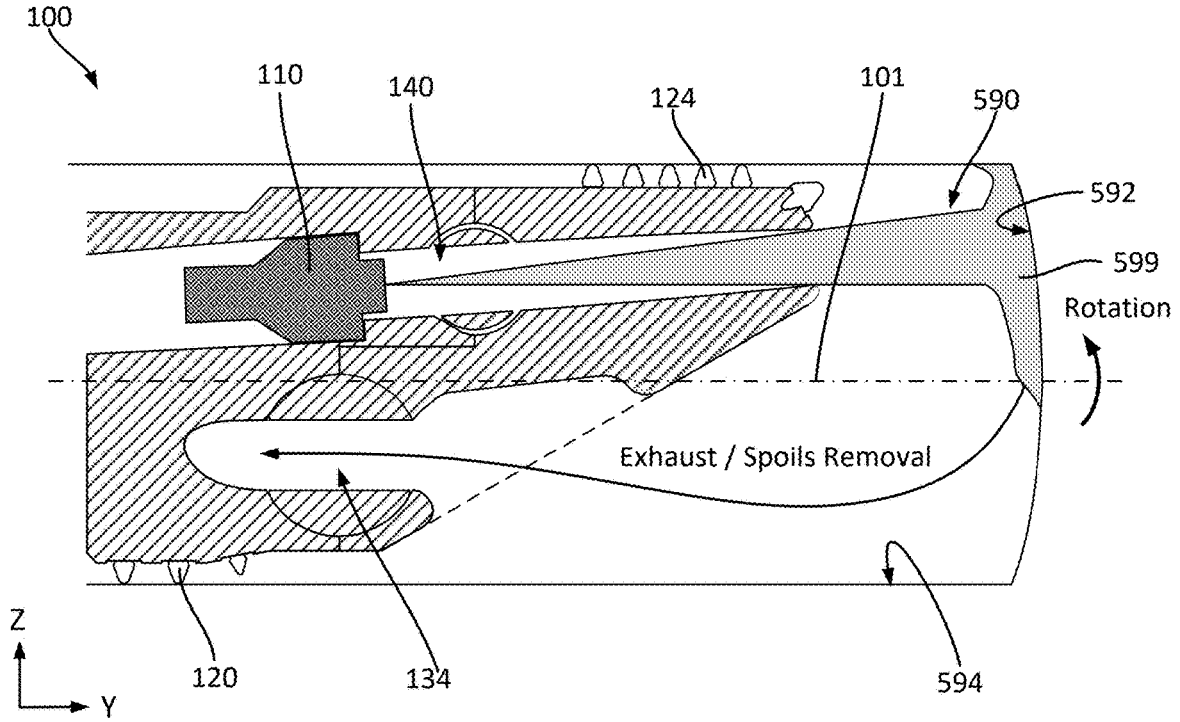
Figure 3H:
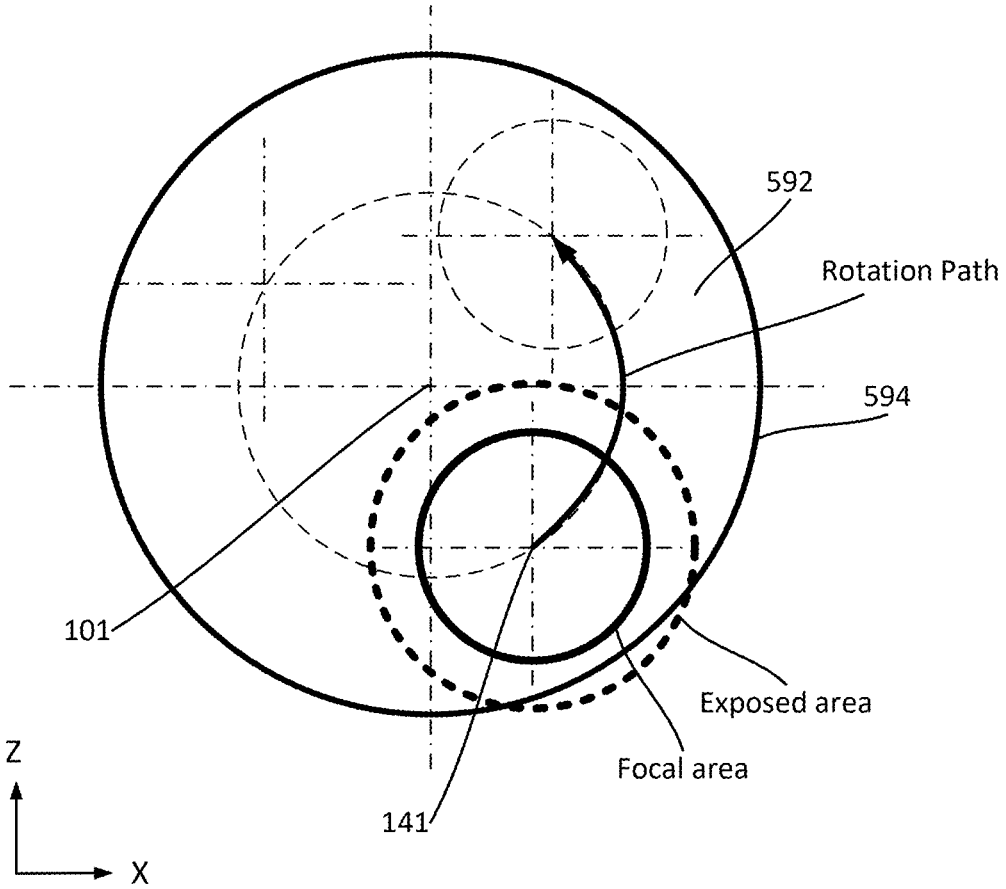
FIG. 3H is a schematic illustration of a bore face showing a focal area of the thermal stream and an exposed area on the bore face.

Referring to FIG. 3A, the thermal stream axis 141 is not colinear or parallel to the primary axis 101 thereby enabling location control of an interface between the thermal stream 599 and the bore face 592 as, e.g., schematically shown in FIGS. 3F-3H. The location control is provided by a rotational angle of the hybrid boring head 100 about the primary axis 101. For example, an angle (B) between the thermal stream axis 141 and the primary axis 101 may be 0-20° or, more specifically, 0-10°, such as 0-5°.

As shown in FIG. 3E, the offset of the thermal torch device 111 relative to the front orifice 148 determines a spread angle ($\alpha$) of the thermal stream 599, which may be 0-15° or, more specifically, 0-5°.

Referring to FIGS. 3F and 3G, in some examples, the hybrid boring head 100 is steerable when forming a portion of the underground tunnel 590 through the rock 584 by controlling a dwell time of the thermal stream 599 on portions of the bore face 592 during rotation.

In further examples, the hybrid boring head 100 is configured to prevent ground 580 from entering the thermal unit opening 140 through the front orifice 148. For example, a shutter may be positioned at a front orifice 148. Furthermore, water may be flown through the thermal unit opening 140 or even through the thermal torch device 111 (as further described below).

In some examples, the position of the thermal torch device 111 relative to the frame 130 is adjustable (e.g., during the operation of the hybrid boring head 100). For example, the thermal torch device 111 may be slid within the thermal unit opening 140 relative to the front orifice 148 to change the spread angle ($\alpha$) of the thermal stream 599. In the same or other examples, the thermal torch device 111 may be pivotable relative to the frame 130 thereby changing an angle between the primary axis 101 and the thermal stream axis 141.

In some examples, the power output of the thermal torch device 111 is adjustable and is different for the different ones of multiple operating modes of the hybrid boring head 100. For example, the flow rates of the fuel and air may be changed when the thermal torch device 111 is a burner. In another example, the electrical power may be changed when the thermal torch device 111 is a plasma torch.

In some examples, the hybrid boring head 100 comprises one or more additional thermal torch devices 112 attached to the frame 130 and configured to generate additional thermal streams directed to the bore face 592, wherein a path of the thermal stream axis 141 on the bore face 592 is offset relative to paths of the additional thermal stream axes, e.g., as shown and described above with reference to FIGS. 2A-2F.

Referring to FIGS. 3A-3E, the mechanical boring implements 120 is attached to the frame 130 and configured to contact and remove the ground 580 from the bore face 592 while boring the underground tunnel 590, wherein the set of mechanical boring implements 120 is selected from the group consisting of mechanical rollers, mechanical teeth, and hard-faced structural elements.

Referring to FIG. 3A, in some examples, the set of mechanical boring implements 120 are mechanical teeth comprising a front set 122, a reaming set 124, and a crushing set 126. The front set 122 is configured to form the bore face 592. The reaming set 124 is configured to form a tunnel wall 594. The crushing set 126 is configured to assist the ground 580 to pass through the drain openings 134.

In some examples, the set of mechanical boring implements 120 comprises abrasion-resistant coatings or inserts comprising one or more materials selected from the group consisting of tungsten carbide, boron carbide, and polycrystalline diamond.

Referring to FIGS. 2A-2F, in some examples, the set of mechanical boring implements 120 is offset relative to the thermal stream axis 141 such that the thermal stream 599 does not contact the set of mechanical boring implements 120.

Referring to FIG. 5C, in some examples, the hybrid boring head 100 further comprises one or more sensors 150 configured to measure one or more of (a) torque between the hybrid boring head 100 and the head actuating unit 510, (b) thrust between the hybrid boring head 100 and the head actuating unit 510, (c) pressure inside the underground tunnel 590, and (d) temperature of one or more components of the hybrid boring head 100.

Examples of Operating Methods

Figure 4:
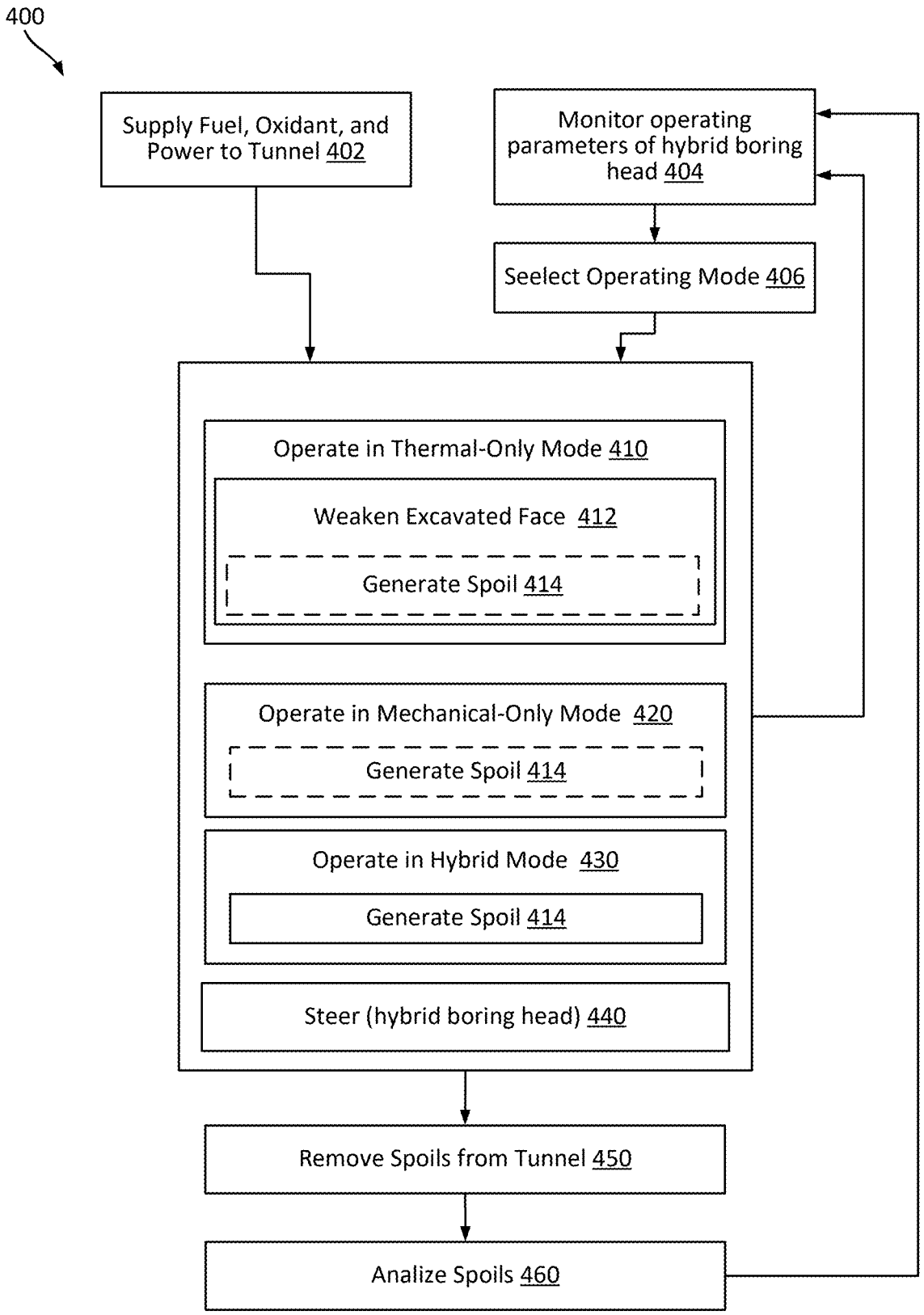
FIG. 4 is a process flowchart corresponding to a method of operating a hybrid boring system to form an underground tunnel, in accordance with some examples.

FIG. 4 is a process flowchart of hybrid tunnel boring method 400 using a hybrid boring head 100 comprising a thermal unit 110 and a set of mechanical boring implements 120, in accordance with some examples. Various examples of the hybrid boring head 100 are described above. Specifically, one or more TTDs of the thermal unit 110 are configured to cover most or all of the target cross-sectional area defined by the target bore diameter.

In some examples, method 400 may comprise (block 402) supplying one or more of fuel, oxidant, and power to the hybrid boring head 100 or, more generally, to the hybrid boring system 500 positioned in an underground tunnel 590. FIGS. 5A-5B illustrates some aspects of this operation and connection lines between a portion of the hybrid boring system 500 positioned underground and another portion positioned outside of the tunnel (e.g., an external unit 520). The supply may depend on the type of the thermal unit 110, the head actuating unit 510, and other aspects of the hybrid boring system 500.

In some examples, method 400 may comprise (block 404) monitoring operating parameters of the hybrid boring head 100. These parameters may be used to determine the operating mode for the hybrid boring head 100. For example, the hybrid boring head 100 may be configured in either one of these boring operational modes: (1) mechanical-only mode, (2) thermal-only mode, and (3) combined/hybrid mechanical and thermal mode. Non-boring operational modes may include: (4) intentional flooding of bore or subsurface pockets with combustible gases for detonation/demolition purposes, (5) burn-off modes for safe handling of encountered subsurface gas pockets (anthropogenic or natural), both for safety/reliability in support of boring operational modes OR for rescue burn-off-as-as-service for other construction/tunneling processes that have encountered subsurface gas. In addition, a combustion-based convective embodiment could utilize combustible fuel sensors in the stream to detect and enter modes for burnoff of subsurface encountered gas, whether anthropogenic or naturally occurring in origin. This operating mode is important for safety and reliability, but also may itself be commercially saleable for safe burnoff of pockets encountered by other construction or tunneling processes, ie burnoff-for-hire]

Various sensors (e.g., force, pressure, temperature) provided on various components of the overall hybrid boring system 500 may be used for this purpose. One example of these operating parameters includes, e.g., a torque required to rotate the hybrid boring head 100 (while advancing at a set linear speed along the primary axis 101). Specifically, soft soil requires a lower torque, while hard rocks require a significantly higher torque. Therefore, changes in the torque value may be used to switch the operating mode, e.g., an increase in torque by at least 50% relative to a baseline level may trigger the activation of the thermal unit 110.

In some examples, method 400 may comprise (block 406) determined an operating mode, e.g., based on the operating parameters received earlier. Various aspects of this operation are described above in the context of different operating parameters. As noted above, the hybrid tunnel boring systems and methods described herein are configured to operate in multiple modes depending on ground conditions, including a mechanical-only mode, a thermal-only mode, and a hybrid mode. In the mechanical-only mode, the boring head advances through the ground using a set of mechanical boring implements, such as rollers or teeth, without activating the thermal torch device. This mode is particularly suitable for soft or displaceable soils where thermal processing is unnecessary or inefficient. Mechanical-only operation reduces energy consumption and eliminates thermal system wear. Sensor feedback—including torque, thrust, and spoil flow rate—may be used to monitor tool performance and detect transitions in-ground type.

In contrast, the thermal-only mode utilizes the thermal torch device to deliver focused energy to the bore face, inducing thermal spallation or microfracturing of high-compressive-strength materials without active mechanical contact. This mode is advantageous when boring through super hard or abrasive rock formations that would otherwise cause excessive wear on mechanical implements. During thermal-only operation, the head may rotate slowly or remain stationary, and spoil may be removed via entrainment in the thermal jet stream. This mode can also be used to precondition the rock ahead of hybrid or mechanical operation, improving overall boring efficiency.

Method 400 comprises (block 410) operating the hybrid boring head 100 in a thermal-only mode to precondition or spall the rock 584 using the thermal torch device 111 while positioning at least some of the set of mechanical boring implements 120 away from the rock 584. Specifically, applying thermal processing to a rock using the thermal unit 110 thereby at least creating micro-fractures in the rock and forming a preconditioned rock. Specifically, one or more TTDs deliver the thermal energy to the target cross-section in order to precondition the rock, for example, via thermal weakening and/or thermal spallation (volumetric removal) from the center expanding outward. This thermal processing may remove spoils via spallation but at least weakens the rock to a certain depth, making it easier to remove mechanically, if desired. This process can occur prior to, alternating with, or in parallel with mechanical processing, which may be also referred to as excavation.

In general, applying thermal processing comprises (block 412) weakening the excavated face of the rock, which simplifies further removal of this weakened rock. In more specific examples, (block 412) weakening the excavated face of the rock comprises generating a spoil or, more specifically, generating a thermally-removed spoil by removing at least a portion of the weakened rock. The thermally-removed spoil should be distinguished from the mechanically-removed spoil as these spoil types are removed during different operations and by applying different means (thermal processing vs. mechanical processing). Overall, in one or more modes, the hybrid tunnel boring method 400 comprises (block 414) generating the spoils.

In some examples, the hybrid tunnel boring method 400 may comprise retracting the hybrid boring head 100 away from a bore face when transitioning into the thermal-only mode.

Method 400 comprises (block 420) operating the hybrid boring head 100 in a mechanical-only mode by not supplying power to the thermal torch device 111 and engaging the soil 582 with the set of mechanical boring implements 120. Applying mechanical processing to at least the preconditioned rock using the set of mechanical boring implements 120 thereby removing the preconditioned rock and (block 414) generating a mechanically-removed spoil. Specifically, the set of mechanical boring implements 120 or, more specifically, one or more mechanical devices (e.g., rollers and/or teeth) affect the removal of the thermally weakened rock. Mechanical excavation is able to remove the preconditioned rock more efficiently, expanding the bore to the final target diameter.

Method 400 comprises (block 430) operating the hybrid boring head 100 in a hybrid mode in which both the set of mechanical boring implements 120 and the thermal torch device 111 are active simultaneously. For example, removing the portion of the rock while applying the thermal processing to the rock using the thermal unit 110 forms a bore in the rock having a first diameter (D1). Applying the mechanical processing enlarges the bore in the rock to a second diameter (D2), larger than the first diameter.

In some examples, the hybrid boring head 100 transitions among the thermal-only mode, the mechanical-only mode, and the hybrid mode without removing the hybrid boring head 100 from the underground tunnel 590. In further examples, the hybrid boring head 100 transitions among the thermal-only mode, the mechanical-only mode, and the hybrid mode based on detected changes in the composition of the ground 580. Furthermore, the hybrid boring head 100 transitions to the mechanical-only mode based on detecting the soil 582. The hybrid boring head 100 may transition to the thermal-only mode or the hybrid mode based on detecting the rock 584.

In some examples, the hybrid boring head 100 is advanced along a primary axis 101 while rotating about the primary axis 101 in each of the mechanical-only mode, the thermal-only mode, and the hybrid mode.

The hybrid tunnel boring method 400 may further comprise (block 440) steering the hybrid boring head 100 within the ground 580 by controlling the rotational orientation of the hybrid boring head 100. For example, steering is performed in the mechanical-only mode by fixing the rotational orientation and axially advancing the hybrid boring head 100. Furthermore, steering may be performed in the thermal-only mode or the hybrid mode by modulating the dwell time of thermal stream 599 produced by thermal torch device 111 at the rotational orientation of the hybrid boring head 100.

Overall, operating the hybrid boring head 100 in one of the thermal-only mode, the mechanical-only mode, and the hybrid mode generates spoils. As such, the hybrid tunnel boring method 400 further comprises (block 450) removing the spoils from the underground tunnel 590.

In some examples, the hybrid tunnel boring method 400 further comprises (block 460) analyzing the spoils removed from underground tunnel 590 for at least one of composition, size, color, and temperature. This information may be used for selecting among the mechanical-only mode, the thermal-only mode, and the hybrid mode (block 406).

In some examples, the hybrid tunnel boring method 400 further comprises blocking the thermal torch device 111 from spoil intrusion.

Examples of Hybrid Boring Systems

FIGS. 5A and 5B are schematic views of a hybrid boring system 500 while forming an underground tunnel 590, in accordance with some examples. The hybrid boring system 500 comprises a hybrid boring head 100, a head actuating unit 510, and an external unit 520. The hybrid boring head 100 and the head actuating unit 510 are positioned within the underground tunnel 590, while the external unit 520 is positioned outside of the underground tunnel 590 and is used to provide power, fuel, and oxidant to the hybrid boring head 100 and the head actuating unit 510 (e.g., using a set of lines extending between the head actuating unit 510 and the external unit 520). The external unit 520 may also receive spoils generated while forming the underground tunnel 590. In this particular example, the head actuating unit 510 is shown as a self-propelled unit that moves inside the tunnel. However, other examples are also within the scope, e.g., jacking pipes from the external unit 520, installing tunneling segments that can be used for the head actuating unit 510 as a supporting surface from where the head actuating unit 510 can push itself forward, and the like.

Referring to FIG. 5B, the head actuating unit 510 supports the hybrid boring head 100 and rotates the hybrid boring head 100 relative to the underground tunnel 590. This rotation and operation of the hybrid boring head 100 removes the rock from the bore face 592 and extends the tunnel wall 594. Specifically, FIG. 5B illustrates thermal zones 115 generated by thermal unit 110 or, more specifically, by a set of thermal torch devices (TTDs) of thermal unit 110. As described above, thermal zones 115 cause the micro-fracturing of the rock and forms a preconditioned rock. In some examples, some rock is thermal-spalled as a result of being exposed to these thermal zones 115. The thermal unit 110 can be directed to one or both of the bore face 592 and extend the tunnel wall 594.

FIG. 5C is a schematic block diagram of the hybrid boring system 500, in accordance with some examples. In some examples, a head actuating unit 510 is mechanically coupled to the hybrid boring head 100 by a shaft 511 for rotating the hybrid boring head 100 about the primary axis 101 and advancing the hybrid boring head 100 along the primary axis 101 while boring the underground tunnel 590.

In some examples, the hybrid boring system 500 further comprises a system controller 550 configured to select one of the multiple operating modes and to steer the hybrid boring head 100 through the ground 580, both the soil 582 and the rock 584, while boring the underground tunnel 590. For example, the hybrid boring head 100 comprises one or more sensors 150 configured to measure one or more of (a) torque between the hybrid boring head 100 and the shaft 511, (b) thrust between the hybrid boring head 100 and the shaft 511, (c) pressure inside the underground tunnel 590, and (d) temperature of one or more components of the hybrid boring head 100. The system controller 550 is configured to receive input from one or more sensors 150 and select one of the multiple operating modes based on the input.

In some examples, the head actuating unit 510 is configured to measure (a) torque between the head actuating unit 510 and the shaft 511 and (b) thrust between the head actuating unit 510 and the shaft 511. In these examples, the system controller 550 is configured to receive additional input from the head actuating unit 510 and select one of the multiple operating modes based on the input.

In some examples, the system controller 550 is configured to vary the rotational speed and translation speed of the hybrid boring head 100 based on a current one of the multiple operating modes and/or based on the angular position of the hybrid boring head 100.

In some examples, The external unit 520 is configured to receive the spoils from the hybrid boring head 100 and analyze the spoils for at least one composition, size, color, and temperature.

In some examples, the external unit 520 comprises one or more inspection units configured to analyze the spoils and selected from the group of a vision unit, an artificial intelligence (AI) unit trained on spoil analysis and selection of the operating modes.

In some examples, the external unit 520 is further configured to steer the hybrid boring head 100 by controlling power to the thermal torch device 111 based on inputs from one or more inspection units.

In some examples, the external unit 520 is configured to supply (a) power to the thermal torch device 111 when forming a portion of the underground tunnel 590 through the rock 584 using a power supply line 531 and (b) a drilling fluid to the hybrid boring head 100 when forming a portion of the underground tunnel 590 through the soil 582 using a drilling-fluid supply line 532.

In some examples, the thermal torch device 111 is a burner comprising a fuel inlet 161, an oxidant inlet 162, and a 3-way valve 163 connected to the oxidant inlet 162. The external unit 520 is configured to supply oxidant to the thermal torch device 111 using an oxidant supply line 533. The 3-way valve 163 is fluidically coupled to both the drilling-fluid supply line 532 and the oxidant supply line 533 thereby allowing the drilling fluid to flow through the thermal torch device 111 when forming a portion of the underground tunnel 590 through the soil 582 using a drilling-fluid supply line 532.

In some examples, the power supply line 531 is configured to supply one or more of electricity, propane, and diesel.

In some examples, the external unit 520 comprises a gas detection module configured to detect natural gas within underground tunnel 590 and enter a burnoff mode. For example, the thermal torch device 111 may be configured to perform the burnoff mode by supplying oxidant to the thermal torch device 111.

In some examples, the head actuating unit 510 is a part of the external unit 520. Alternatively, the head actuating unit 510 is positioned inside the underground tunnel 590 during the operation of the hybrid boring system 500, e.g., as shown in FIGS. 5A-5B.

In some examples, the external unit 520 comprises a cooling subunit 522 fluidically coupled with the hybrid boring head 100 and configured to circulate cooling liquid between the cooling subunit 522 and the hybrid boring head 100.

Overall, the hybrid boring system 500 may be a micro tunnel boring machine (MTBM), a horizontal directional drilling (HDD) system, or some other system.

System Controller Examples

Figure 5D:
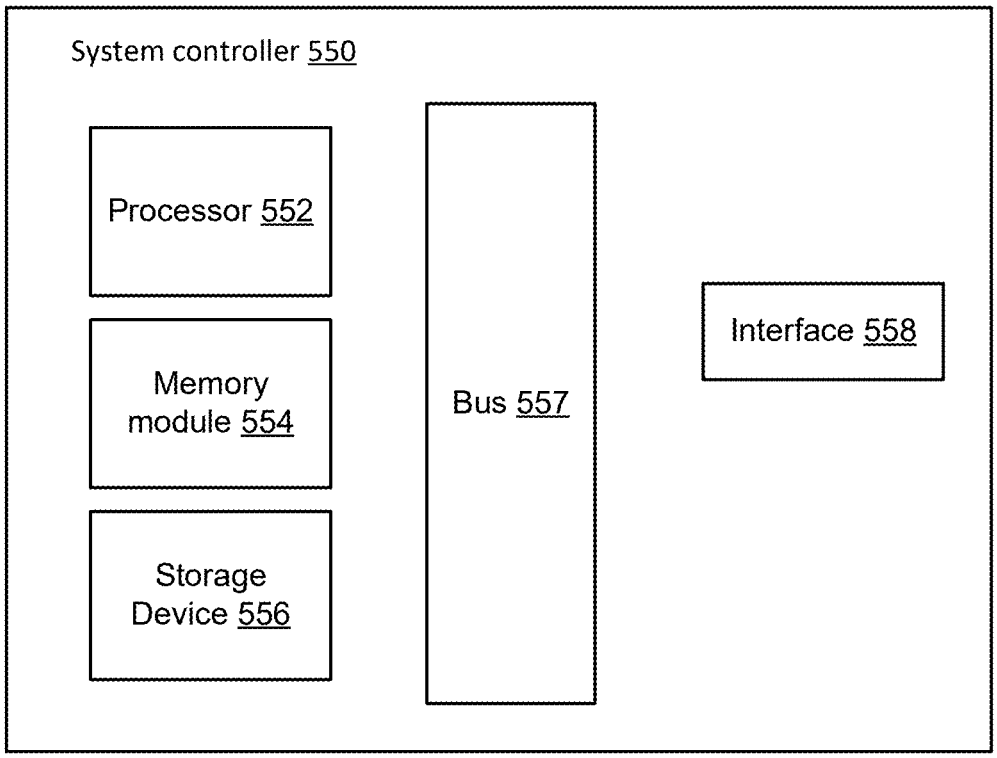
FIG. 5D illustrates a block diagram of a system controller, in accordance with some examples.

FIG. 5D illustrates a block diagram of a system controller 550, in accordance with some examples. The system controller 550 is configured for implementing examples (e.g., operating stems of method 400) described herein and comprises a processor 552, a memory module 554, a storage device 556, an interface 558, and a bus 557 (e.g., a PCI bus or other interconnection fabric.) The system controller 550 may operate as a variety of devices such as a server system such as an application server and a database server, a client system such as a laptop, desktop, smartphone, tablet, wearable device, set-top box, etc., or any other device or service described herein.

Although a particular configuration is described, a variety of alternative configurations are possible. The processor 552 may perform operations such as those described herein. Instructions for performing such operations may be embodied in the memory module 554, on one or more non-transitory computer-readable media, or on some other storage device. Various specially configured devices can also be used in place of or in addition to the processor 552. The interface 558 may be configured to send and receive data packets over a network. Examples of supported interfaces include, but are not limited to: Ethernet, fast Ethernet, Gigabit Ethernet, frame relay, cable, digital subscriber line (DSL), token ring, Asynchronous Transfer Mode (ATM), High-Speed Serial Interface (HSSI), and Fiber Distributed Data Interface (FDDI). These interfaces may include ports appropriate for communication with the appropriate media. They may also include an independent processor and/or volatile RAM. A computer system or computing device may include or communicate with a user interface (e.g., a monitor, printer, or other suitable display) for providing any of the results mentioned herein to a user.

CONCLUSION

Although the foregoing concepts have been described in some detail for purposes of clarity of understanding, it will be apparent that certain changes and modifications may be practiced within the scope of the appended claims. It should be noted that there are many alternative ways of implementing processes, systems, and apparatuses. Accordingly, the present embodiments are to be considered illustrative and not restrictive.

The invention claimed is:

1. A hybrid boring head defined by a primary axis and configured for boring an underground tunnel through ground comprising both soil and rock using different ones of multiple operating modes of the hybrid boring head, the hybrid boring head comprising:

a frame configured to rotate about the primary axis and to advance along the primary axis while boring the underground tunnel, the frame comprising:

a spoil drain opening, a thermal unit opening extending through the frame and comprising a front orifice and a back orifice, and a thermal-opening valve positioned within the thermal unit opening and configured to move between an open position and a shut position;

a thermal torch device positioned within the thermal unit opening between the thermal-opening valve and back orifice, wherein:

the thermal torch is configured to generate a thermal stream at least along a thermal stream axis directed to a bore face formed by the hybrid boring head in the underground tunnel while boring the underground tunnel, the thermal torch device is selected from the group consisting of a burner, a turbine, and a plasma torch, the thermal-opening valve, while in the shut position, isolates the thermal torch from the front orifice, and the thermal-opening valve, while in the open position, opens the thermal torch to the front orifice; and a set of mechanical boring implements attached to the frame and configured to contact and remove the ground from the bore face while boring the underground tunnel, wherein the set of mechanical boring implements is selected from the group consisting of mechanical rollers, mechanical teeth, and hard-faced structural elements.

2. The hybrid boring head of claim 1, wherein:

the thermal stream axis is not parallel to the primary axis, thereby enabling location control of an interface between the thermal stream and the bore face, and the location control is provided by a rotational angle of the hybrid boring head about the primary axis.

3. The hybrid boring head of claim 1, wherein:

the front orifice is configured to direct the thermal stream to the bore face, and the back orifice is configured to house one or more lines for operating the thermal torch device positioned in the thermal unit opening.

4. The hybrid boring head of claim 1, wherein the thermal torch device is recessed into the thermal unit opening away from the front orifice.

5. The hybrid boring head of claim 1, wherein an offset of the thermal torch device relative to the front orifice determines a spread angle of the thermal stream as the thermal stream exits the thermal unit opening and is directed to the bore face.

6. The hybrid boring head of claim 5, wherein the hybrid boring head is steerable when forming a portion of the underground tunnel through the rock by controlling a dwell time of the thermal stream on portions of the bore face during rotation.

7. The hybrid boring head of claim 1, wherein position of the thermal torch device within the thermal unit opening relative to the frame is adjustable.

8. The hybrid boring head of claim 1, wherein the thermal torch device is pivotable relative to the frame, thereby changing an angle between the primary axis and the thermal stream axis.

9. The hybrid boring head of claim 1, wherein the thermal torch device is axially movable within the thermal unit opening, thereby changing a spread angle of the thermal stream as the thermal stream exits the thermal unit opening and is directed to the bore face.

10. The hybrid boring head of claim 1, wherein a power output of the thermal torch device is adjustable and is different for the different ones of the multiple operating modes of the hybrid boring head.

11. The hybrid boring head of claim 1, further comprising one or more additional thermal torch devices attached to the frame and configured to generate additional thermal stream directed to the bore face, wherein a path of the thermal stream axis on the bore face is offset relative to paths of additional thermal stream axis.

12. The hybrid boring head of claim 1, wherein the frame comprises a steering surface that is not colinear or parallel to the primary axis thereby enabling steering of the hybrid boring head while forming the underground tunnel through the soil using a combination a rotational angle of the hybrid boring head about the primary axis and an axial movement of the hybrid boring head along the primary axis.

13. The hybrid boring head of claim 1, wherein the frame further comprises a spoil intake defined by an intake angle and extending between an outer perimeter of the frame and at least one of the spoil drain opening.

14. The hybrid boring head of claim 1, wherein:

the set of mechanical boring implements are mechanical teeth comprising a front set, a reaming set, and a crushing set, the front set is configured to form the bore face, the reaming set is configured to form a tunnel wall, and the crushing set is configured to assist the ground to pass through the drain openings.

15. The hybrid boring head of claim 1, wherein the set of mechanical boring implements comprises abrasion-resistant coatings or inserts comprising one or more materials selected from the group consisting of tungsten carbide, boron carbide, and polycrystalline diamond.

16. The hybrid boring head of claim 1, wherein the set of mechanical boring implements is offset relative to the thermal stream axis such that the thermal stream does not contact the set of mechanical boring implements.

17. The hybrid boring head of claim 1, further comprising one or more sensors configured to measure one or more of (a) torque between the hybrid boring head and the head actuating unit, (b) thrust between the hybrid boring head and the head actuating unit, (c) pressure inside the underground tunnel, and (d) temperature of one or more components of the hybrid boring head.

18. The hybrid boring head of claim 1, wherein:

the frame comprises a drain-opening valve positioned within the spoil drain opening, the drain-opening valve, when shut, prevents flow through the spoil drain opening, and the drain-opening valve, when open, allows the flow through the spoil drain opening.

19. The hybrid boring head of claim 18, wherein:

the frame comprises seeping holes, extending between the spoil drain opening and the set of the mechanical boring implements, and when the drain-opening valve is shut, a drilling fluid is configured to be evenly distributed through the seeping holes from the spoil drain opening.

* * * * *